US009926099B2

(12) United States Patent
Kiefer et al.

(10) Patent No.: US 9,926,099 B2
(45) Date of Patent: Mar. 27, 2018

(54) CUP SLEEVE WITH COASTER

(71) Applicant: Stax Innovations, LLC, Chicago, IL (US)

(72) Inventors: Matthew Kiefer, Chicago, IL (US); Matthew Horney, Chicago, IL (US); Christopher D. Sweet, Chicago, IL (US)

(73) Assignee: STAX INNOVATIONS, LLC, Chicago, IL (US)

( * ) Notice: Subject to any disclaimer, the term of this patent is extended or adjusted under 35 U.S.C. 154(b) by 49 days.

(21) Appl. No.: 15/089,535

(22) Filed: Apr. 2, 2016

(65) Prior Publication Data

US 2016/0288948 A1 Oct. 6, 2016

Related U.S. Application Data

(60) Provisional application No. 62/142,587, filed on Apr. 3, 2015.

(51) Int. Cl.

| | |
|---|---|
| ***B65D 5/10*** | (2006.01) |
| ***B65D 5/36*** | (2006.01) |
| ***B65D 5/02*** | (2006.01) |
| ***B65D 81/38*** | (2006.01) |

(52) U.S. Cl.

CPC ..... *B65D 5/10* (2013.01); *B65D 5/029* (2013.01); *B65D 5/0254* (2013.01); *B65D 5/0281* (2013.01); *B65D 5/3614* (2013.01); *B65D 81/3876* (2013.01)

(58) Field of Classification Search

CPC ..... B65D 5/10; B65D 5/0254; B65D 5/0281; B65D 5/029; B65D 5/3614; B65D 81/3876; B65D 81/3865

USPC .... 229/117, 403, 405, 4.5, 103.11, 109, 110, 229/117.01, 400; 220/592.2, 738, 739, 220/903, 592.17; 206/217

See application file for complete search history.

(56) References Cited

U.S. PATENT DOCUMENTS

| | | | | |
|---|---|---|---|---|
| 2,323,288 | A | 7/1943 | Amberg | |
| 2,335,914 | A * | 12/1943 | Buttery | A47F 1/085 206/499 |
| 3,029,935 | A * | 4/1962 | Nolte | B65D 71/40 206/151 |
| 4,146,169 | A | 3/1979 | Meyers et al. | |
| 4,199,098 | A * | 4/1980 | Lopez | B65D 5/06 229/108.1 |
| 4,492,723 | A * | 1/1985 | Chadwick, II | A63H 33/16 428/11 |
| 5,050,775 | A | 9/1991 | Marquardt | |
| 5,222,656 | A | 6/1993 | Carlson | |
| 5,445,315 | A | 8/1995 | Shelby | |
| 6,026,983 | A | 2/2000 | Graham | |
| 6,412,686 | B1 | 7/2002 | Mahl et al. | |
| D662,784 | S | 7/2012 | Fleck | |
| 8,631,997 | B2 * | 1/2014 | Millet | A47G 21/001 229/114 |

* cited by examiner

*Primary Examiner* — Christopher Demeree
(74) *Attorney, Agent, or Firm* — Rathe Lindenbaum LLP

(57) ABSTRACT

A cup sleeve formed from a blank having a body portion and a coaster portion extending therefrom. The coaster portion being press fit against the body portion in an in-use orientation forming a generally multi-sided sleeve the coaster forming a bottom portion of the sleeve.

17 Claims, 33 Drawing Sheets

CUP SLEEVE WITH COASTER

CROSS REFENRENCE TO RELATED APPLICATOINS

This application claims priority to provisional application Ser. No. 62/142587 filed Apr. 3, 2015 entitled CUP SLEEVE WITH COASTER on the application data sheet filed therewith and identified as CONTAINER WITH LOCKING BOTTOM in the specification which is hereby incorporated herein by reference. A design application is being filed on an even date herewith entitled CUP SLEEVE WITH COASTER including figures identical to certain figures included herewith.

BACKGROUND OF THE INVENTION

Cup sleeves are used to fit over a cup to insulate a user's hands from the hot or cold beverage within the cup. Containers with bottoms are used to contain items.

SUMMARY OF THE INVENTION

In one embodiment a sleeve with a coaster includes a blank having a body portion and a coaster portion extending therefrom. The coaster portion is press fit against the body portion in an in-use orientation forming a generally multi-sided sleeve. The coaster forms a bottom portion of the sleeve.

In one embodiment the multi-sided sleeve includes six sides.

In one embodiment a method for forming a sleeve with a coaster, comprising providing a blank having a body portion and a coaster portion extending therefrom. Press fitting the coaster portion against the body portion forming a generally six sided sleeve with the coaster forming a bottom portion of the sleeve.

In one embodiment a die-cut material self assembles to create a final functional shape through the action of squeezing at least two sides of the die cut material that creates a locking bottom.

In one embodiment a cup holder formed from a single sheet pattern has six sides and an auto locking base that actively engage when the cup holder is moved from a flattened position to an open position.

In one embodiment a die-cut flat packed item self assembles to final functional shape through the action of squeezing a multitude of sides that creates a locking bottom.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION OF THE PREFERRED EMBODIMENTS

Figure 1:
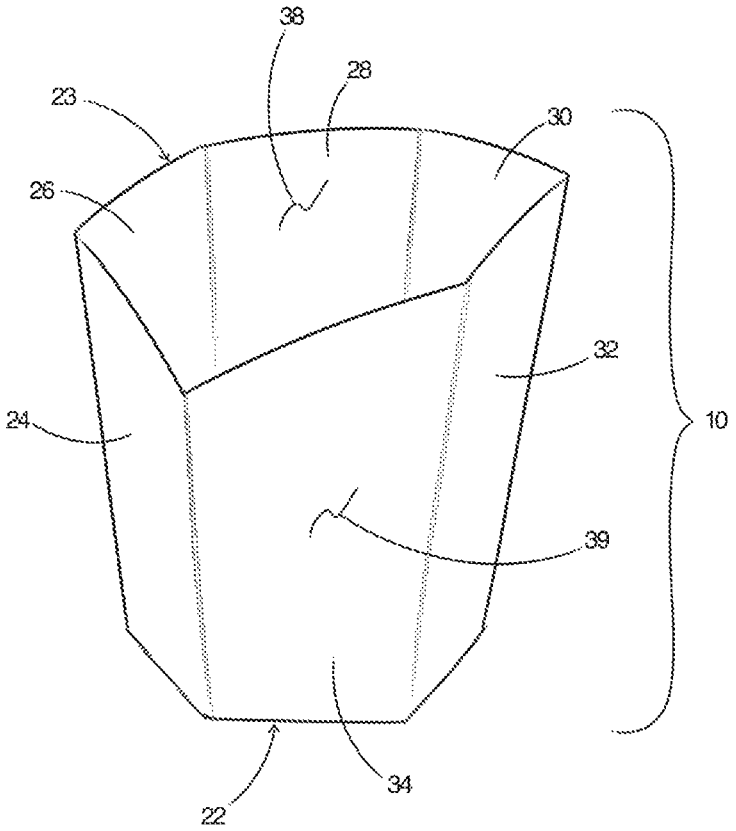
FIG. 1 is an isometric view of a cup holder.
Figure 2:
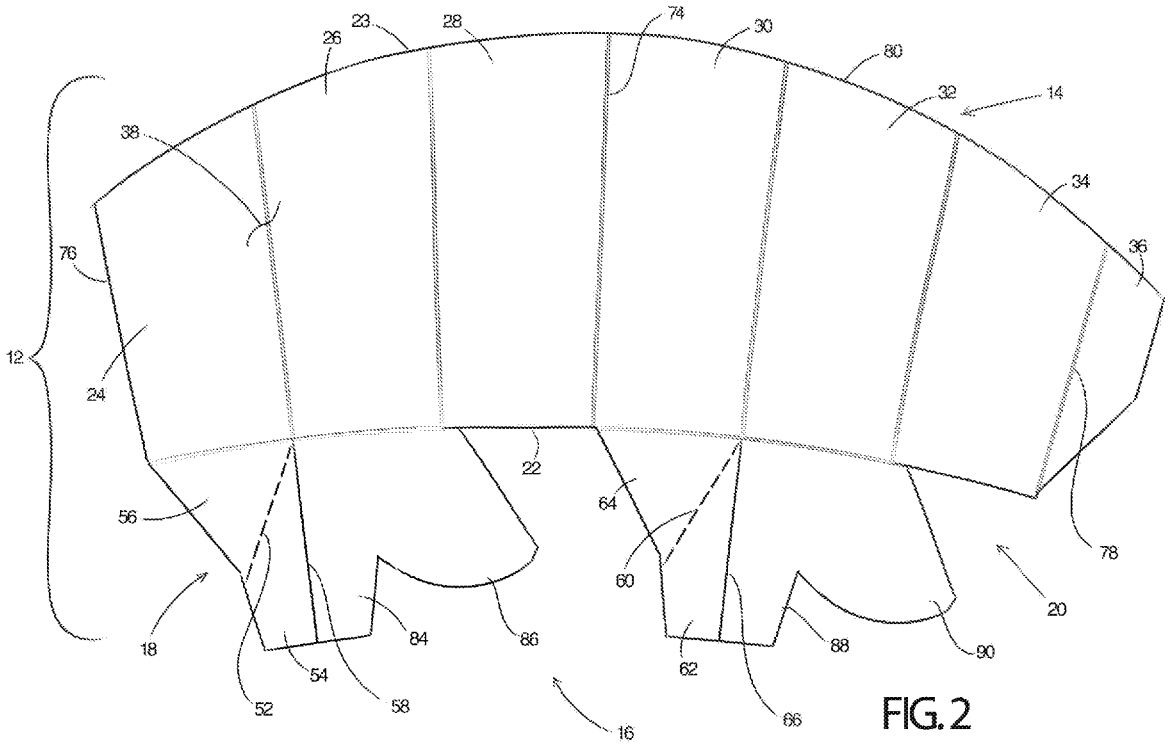
FIG. 2 is view of a pattern of the cup holder in FIG. 2.

Referring to FIG. 1 and FIG. 2 a cup holder 10 is formed from a pattern 12. In one embodiment pattern 12 is formed from a single sheet of material. Pattern 12 is formed of a first body section 14 and a base section 16. Base section 16 includes a first base portion 18 and a second base portion 20. First base portion 18 and second base portion 20 extend from a bottom edge 22 of body section 14. Bottom edge 22 is opposite upper edge 23 of first body section 14.

Body section 14 is formed from 6 panels, 24, 26, 28, 30, 32 and 34 and a tab 36 which extends from tab 26. The inner surface 38 of the pattern 12 forms the inner surface of cup holder 10 in the open and in use position. Inner surface 38 is the surface that faces a cup that is located within cup holder 10 when the cup holder 10 is in the fully opened position and a cup is located in an interior region defined by cup holder 10. Pattern 12 includes an outer surface 39 that is opposite to inner surface 38. Inner surface 38 and opposing outer surface 39 are defined by the orientation of the pattern when the pattern is in a flat non-folded orientation.

Figures 3, 4, 5, 6, 7, 8:
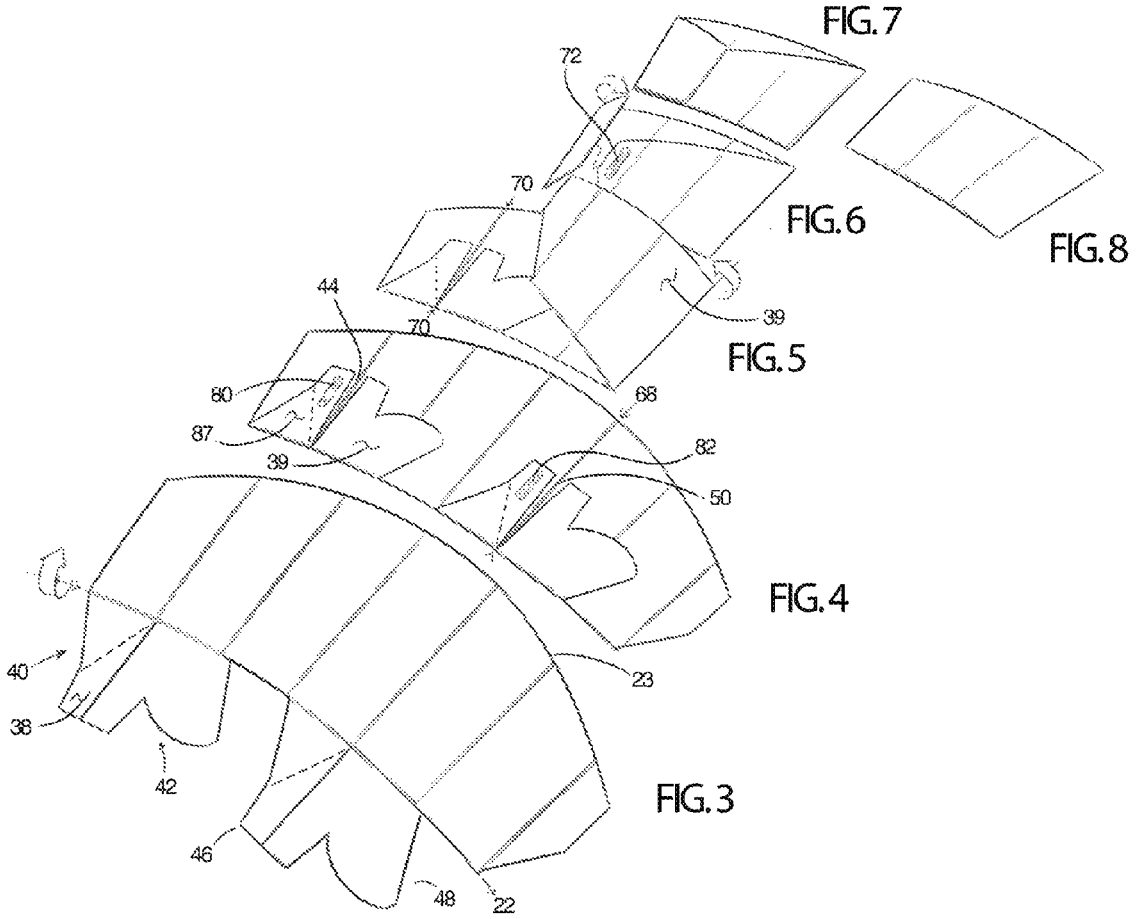
FIG. 3 is a view of the cup holder pattern of FIG. 2 showing the direction that a bottom portion is bent toward a body portion of the pattern.
FIG. 4 is a view of the cup holder pattern of FIG. 2 after the first step.
FIG. 5 is a view of the cup holder pattern of FIG. 2 after the second step.
FIG. 6 is a view of the cup holder pattern of FIG. 2 after the third step.
FIG. 7 is a view of the cup holder in a finished folded orientation.
FIG. 8 is a view of the cup holder pattern of FIG. 6 with a second side illustrated.

Referring to FIG. 3, first and second base portions 18 and 20 are folded upwardly toward body section 14 along an arcuate line 22. Referring to FIG. 4, the inner surface 38 of first base portion 18 is adjacent to the inner surface 38 of body section 14. First base portion 18 includes a first region 40 and a second region 42. In this first folded configuration first region 40 is adjacent to panel 24 and second region 42 is adjacent to panel 26. Referring to FIG. 4 a V shaped gap 44 is created between first region 40 and second region 42. The V-shaped gap 44 is formed because edge 22 is not a straight line. In one embodiment edge 22 is a curved line with an arc portion of a circle defined by a diameter between 300 mm and 30 in, and more preferably 430 mm. Similarly second base portion 20 includes a first region 46 and a second region 48. Second base portion 20 is folded upwardly along edge 22 such that first region 46 is adjacent panel 30 and second region 48 is adjacent panels 32 and 34. Similar to V-shaped gap 44 a V-shaped gap 50 is formed between first region 46 and second region 48 when second base portion 20 is folded upward toward first body section 14. It is also contemplated that each of regions 40, 42, 46 and 48 maybe folded upward toward first body portion 14 individually or together. Is also contemplated that each of first base portion 18 and second base portion 20 are folded up independent of one another.

Referring to FIG. 2, first region 40 of first base portion 18 includes a crease line 52 dividing first region 40 into a finger 54 and a base area 56. A cut line 58 separates first region 40 and second region 42. The cut line 58 and crease line 52 are created when pattern 12 are formed in a stamping die as is known in the art. However it is also contemplated that cut line 58 and crease line 52 are created in a subsequent operation after pattern 12 is created. Similarly first region 46 of second base portion 20 includes a crease line 60 dividing first region 46 into a second finger 62 and a second base area 64. A cut line 66 divides first region 46 and second region 48 of second base portion 20. Cut line 66 and crease line 60 are created when pattern 12 are formed in a stamping die operation.

Referring to FIG. 4 an adhesive 80, 82 is applied to the outer surface 39 of first finger 54 and second finger 62 respectively. Referring to FIG. 5 panels 32, 34 and 36 are folded about line 68 such that the inner surface 38 of panels 32, 34 and 36 are adjacent panels 30, 28, and 26 respectively. As panels 32, 34 and 36 are folded about line 68, region 48 also folds about line 68 such that an extension member 88 of second region 48 contacts adhesive 82 thereby bonding extension member 88 to first second finger 62 of first region 46 of second base portion 20. The bonding of second finger 62 and extension member 88 occur as panels 32, 34 and 36 are folded toward panels 30, 28 and 26 respectively.

Referring to FIG. 6 panel 24 is folded along line 70 such that the inner surface 38 of panel 24 is adjacent the outer surface 39 of tab 36. Referring to FIG. 6 an adhesive 72 is applied to the outer surface 39 of tab 36 such that when the inner surface 38 of panel 24 contacts the outer surface 39 of tab 36 panels 24 and 36 are adhesively secured to one another. Prior to folding panel 24 over panels 26 and 36 an adhesive 80 is applied to the outer surface 39 of first finger 54 that acts to adhere the outer surface 38 of extension 84 of second region 42 to the outer surface of first finger 58.

Referring to FIG. 7 pattern 12 is shown in its folded configuration with the outer surface 39 of panels 24, 34 and 32 being exposed. Referring to FIG. 8, the outer surface 39 of panels 26, 28 and 30 are exposed. Since panels 26, 28 and 30 are larger than panels 24, 34 and 32 respectively, in one orientation panels 26, 28, and 30 completely cover panels 24, 32 and 34. Panels 26, 28 and 30 are larger than panels 24, 32 and 34 in that the surface areas of panels 26, 28 and 30 are greater than the surface areas of panels 24, 32 and 34 respectively.

Referring to FIG. 1 and FIG. 7 panels 24, 26, 28, 30, 32 and 34 are different sizes. In one embodiment the line 74 extending from upper edge 23 to bottom edge 22 that defines division between panel 28 and panel 30 is the longest line as compared to the lines extending from tope edge to bottom edge that divide each of the other panels from one another. In one embodiment line 76 that defines an outer edge of panel 24 has the same length as line 78 which defines the line between panel 34 and panel 36.

Referring to FIG. 1 the upper edge 23 of first body portion 16 in one embodiment is a continuous arcuate line. Upper edge 23 forms the upper edge of cup holder 10 in its fully open and locked position.

Figure 9:
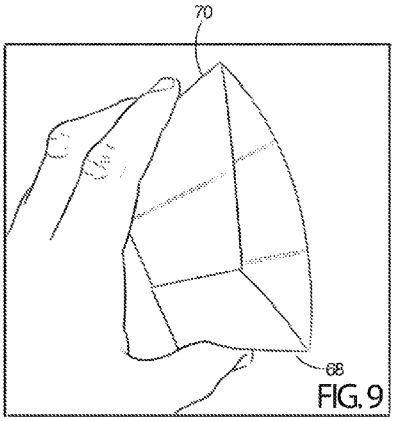
FIG. 9 is a view of the cup holder being opened from a folded position.

Referring to FIG. 9 the first step in the operation of the cup holder 10 as it is moved from the folded position illustrated in FIG. 7 and FIG. 8 to the fully open position illustrated in FIG. 1 includes grasping the outer edges of the folded pattern along lines 68 and 70. A user gently squeezes the folded pattern such that panels 30, 26 and 28 are separate from panels 24, 34 and 32 such that the inner surfaces 38 of panels 30, 26 and 28 are no longer adjacent the inner surfaces of panels 24, 34 and 32.

Figure 10:
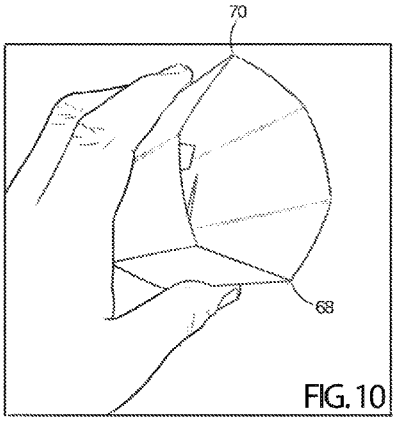
FIG. 10 is a view of the cup holder being further opened from the folded position.
Figure 14:
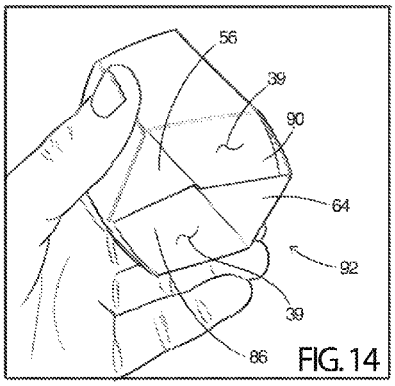
FIG. 14 is an isometric bottom view of the cup holder in the fully opened orientation.
Figure 15A:
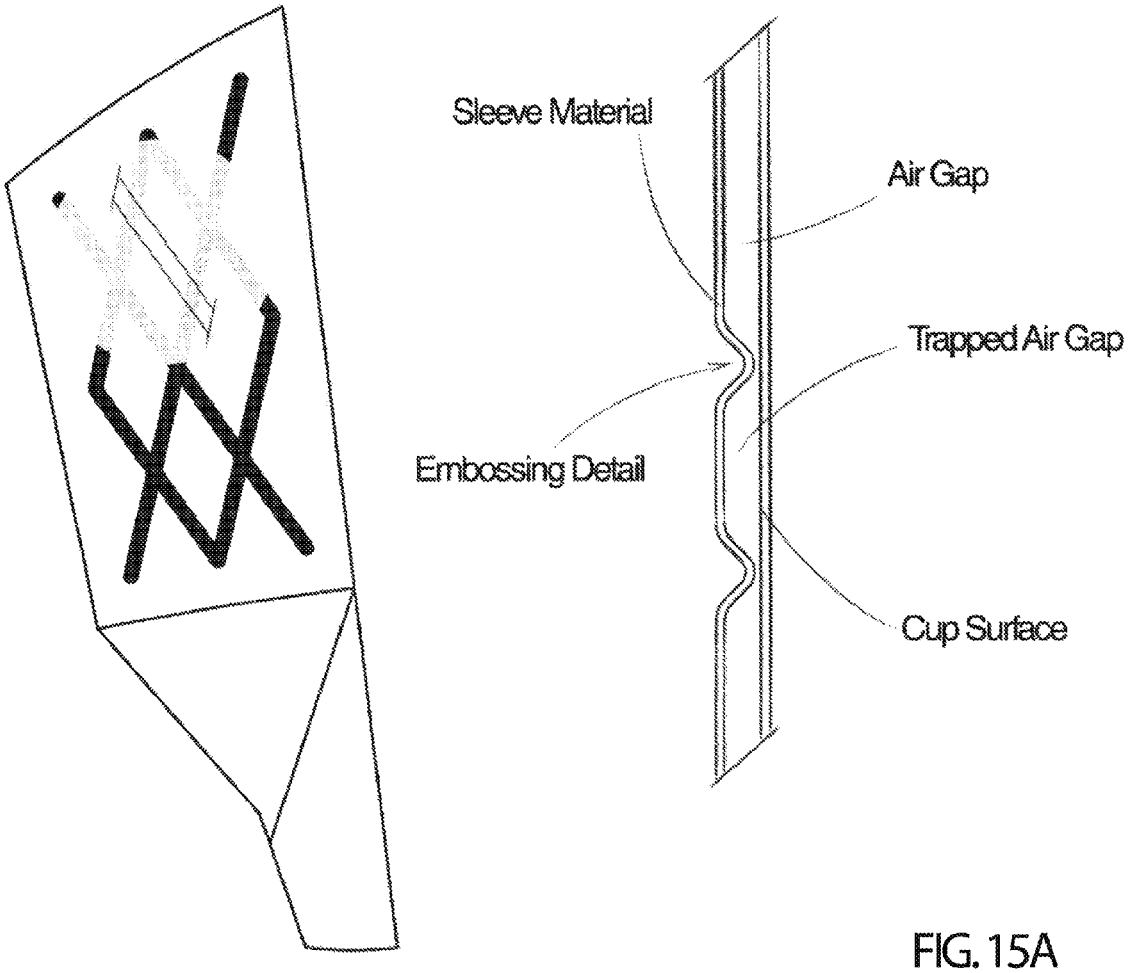
FIG. 15A is a view of an embossing pattern.
Figure 15B:
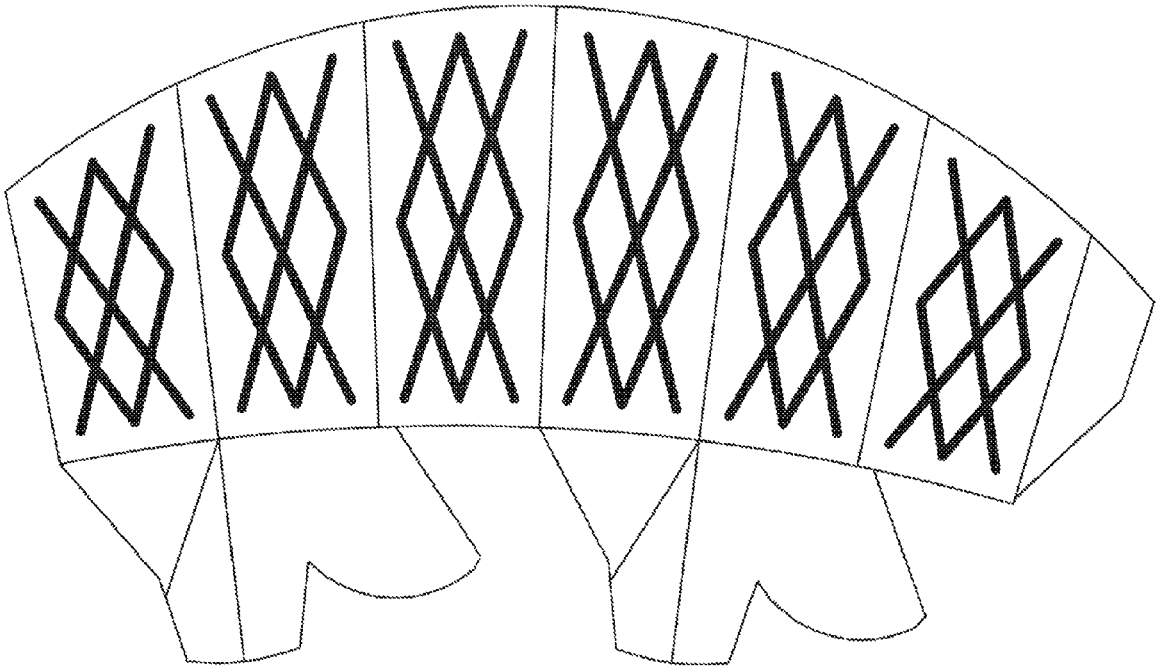
FIG. 15B is a view of a die cut material with an embossing pattern.
Figure 15C:
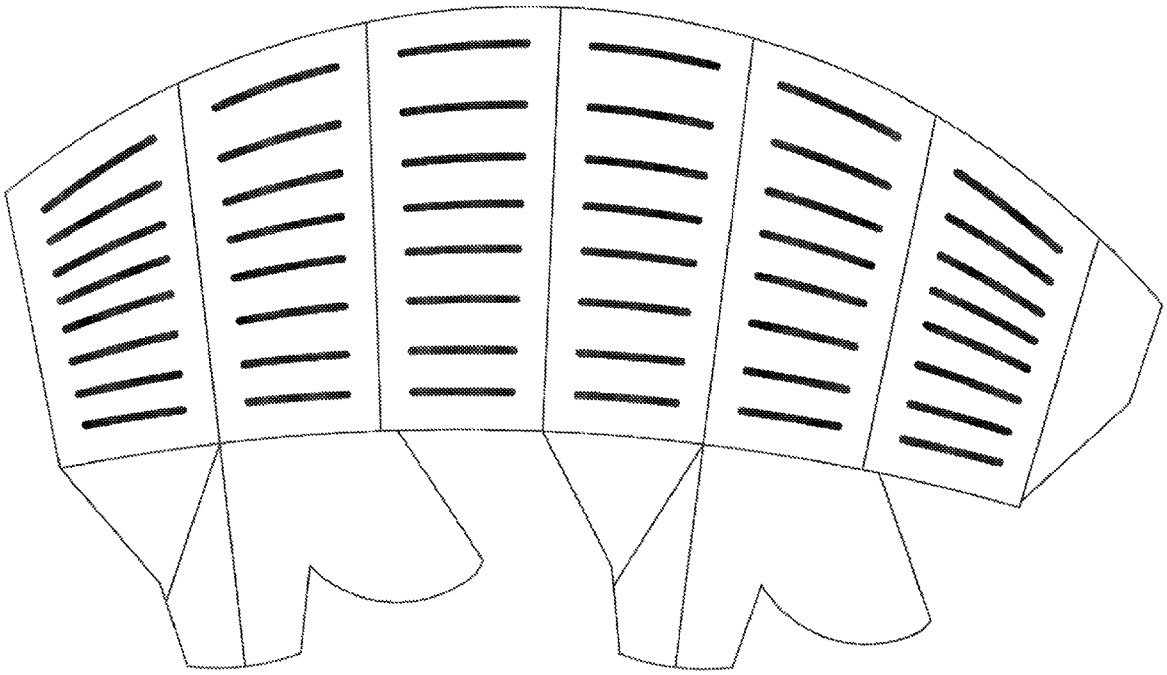
FIG. 15Cis a view of a die cut material with an embossing pattern.
Figure 15D:
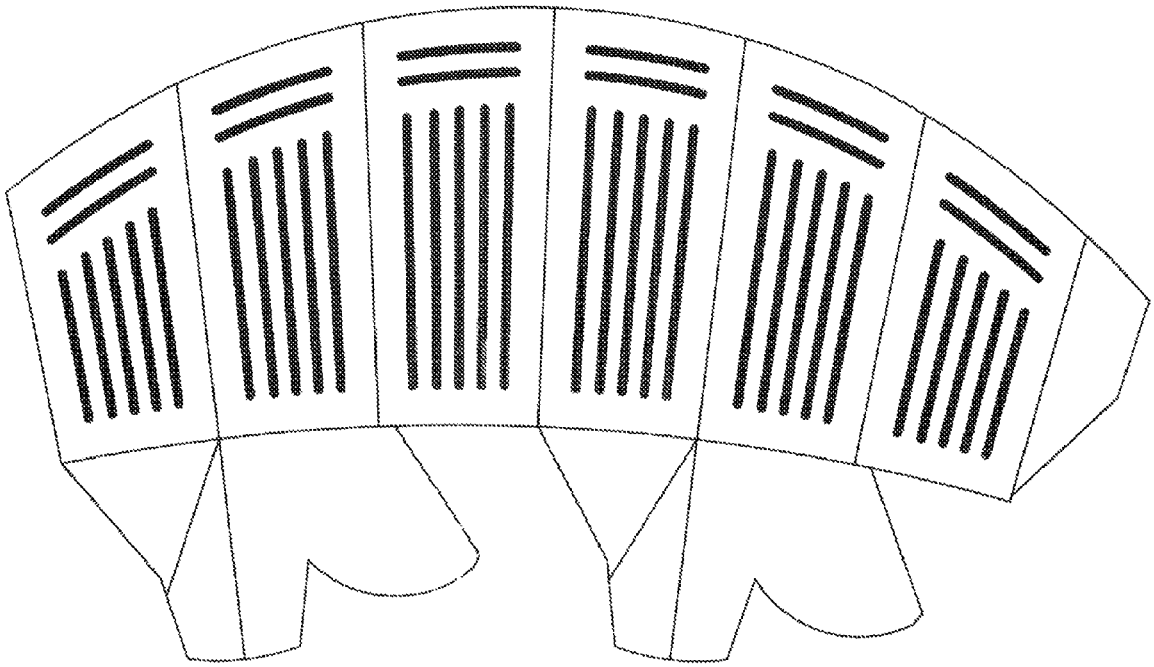
FIG. 15D is a view of a die cut material with an embossing pattern.
Figure 15E:
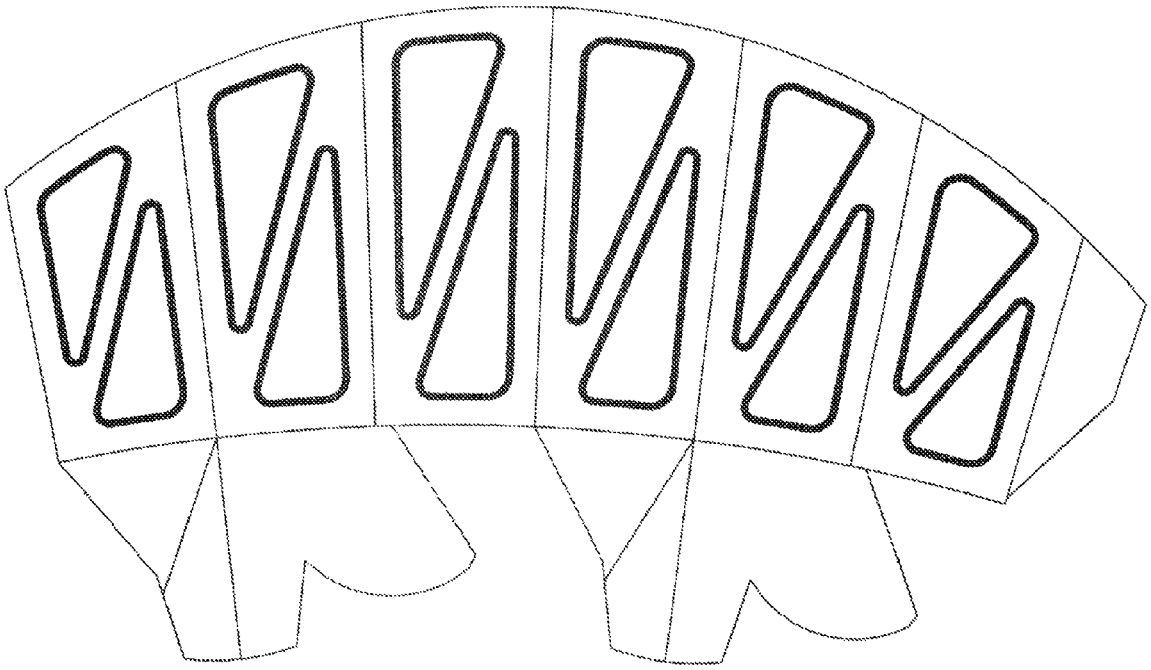
FIG. 15E is a view of a die cut material with an embossing pattern.
Figure 15F:
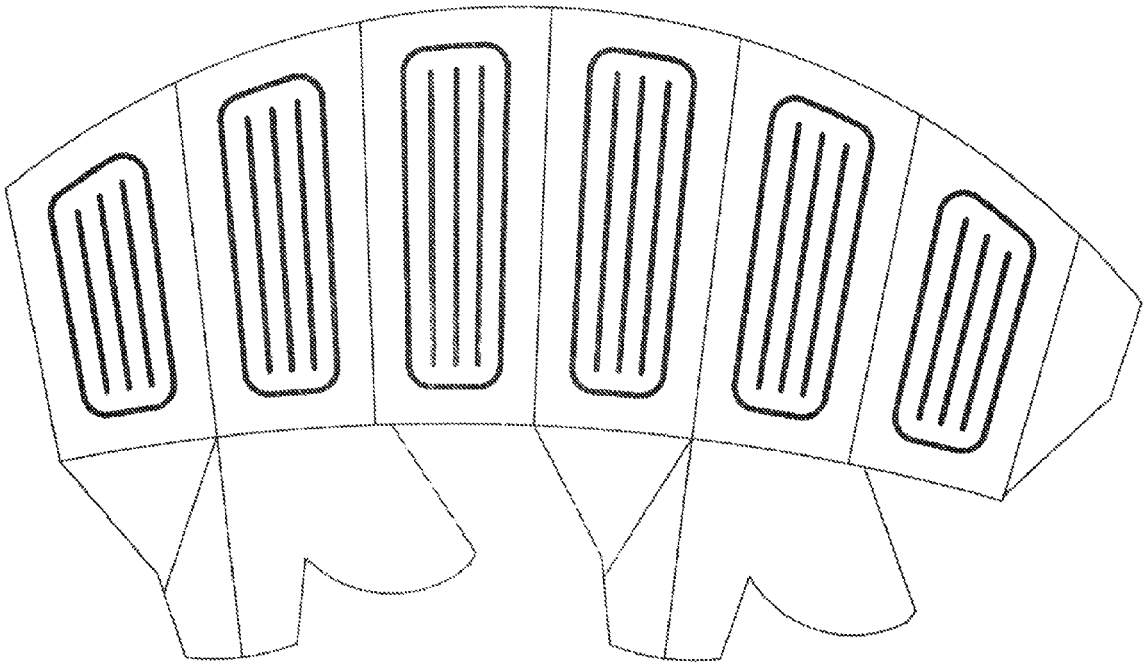
FIG. 15F is a view of a die cut material with an embossing pattern.
Figure 15G:
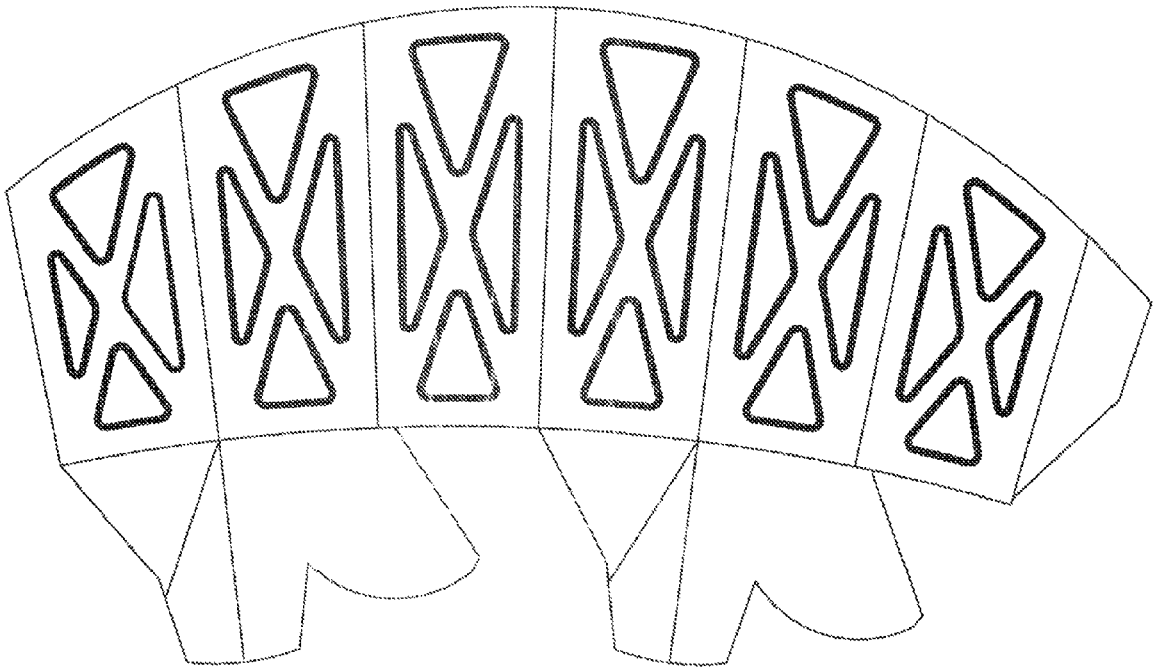
FIG. 15G is a view of a die cut material with an embossing pattern.

Referring to FIG. 10 and FIG. 14 as lines 68 and 70 move toward one another bottom portions 18 and 20 begin to fold from a position proximate the inner surface of panels 26 and 32 toward a plane defined by the bottom edge 22 of panels 24, 26, 28, 30, 32, 34 and 36. In this manner first base portion 18 and second base portion 20 form a base 92 of cup holder 10. Base 92 acts as a coaster that connected to the body portion 20 that forms a sleeve.

Figure 11:
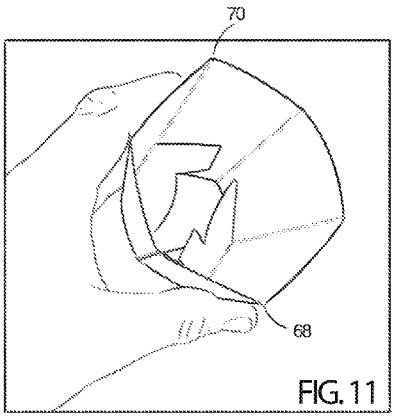
FIG. 11 is an isometric view of the cup holder with the bottom members being engaged with one another.
Figure 12:
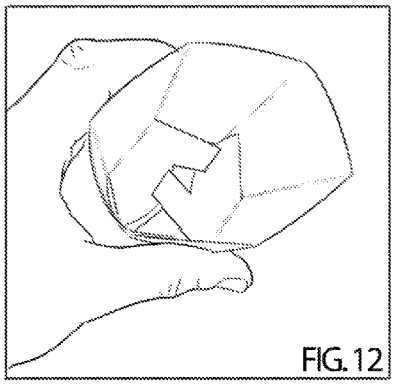
FIG. 12 is top view of the cup holder with the bottom members being engaged.
Figure 13:
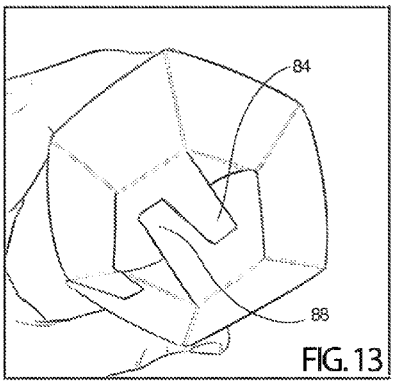
FIG. 13 is a top view of the cup holder in the fully opened orientation.

As discussed earlier outer surface 39 of finger 84 is adhered to outer surface 39 of finger 54. Similarly outer surface of extension 88 is adhered to outer surface 39 of finger 62. Referring to FIG. 11 as portions 42 and 48 are moved from the folded configuration to the fully open configuration they inter weave with one another such that adhered fingers 54 and extension 84 overlay a base area 90 of second base region 20. Similarly, adhered fingers 62 and extension 88 of second base region 20 overlay a base area 86 of first base portion 18. Because of the manner in which finger 54 is connected to base area 56, base area 90 overlays base area 56. Similarly, base area 86 overlays base area 64.

When cup holder 10 is in the fully opened orientation inner surface 38 of finger 54 is adjacent to inner surface 38 of base area 90 and inner surface 38 of finger 62 is adjacent to inner surface 38 of base portion 86. Additionally, outer surface 39 of base area 90 is adjacent inner surface 38 of base area 56 and outer surface 39 of base area 86 is adjacent inner surface 38 of base area 64. This interweaving and imbrication of the first base portion 18 and second base portion 20 create a locking of the first and second base portions 18, 20 to form the base 92 of cup holder 10.

Based on the manner in which the base regions imbricate there are areas in which there are four layers of material in base 92 of cup holder 10. The four layers are found in the region where finger 54, extension 84 overlay base area 90 which intern overlays base area 56. Similarly a second area of four layers is found in the region wherein finger 62, extension 88 overlay base area 86 which in turn overlay base area 64.

The resulting cup holder 10 includes an inner region defined by surface 38 of panels 24, 26, 28, 30, 32, 34, and 36 and inner surface 38 of first and second regions 18 and 20. However the inner surface 38 of fingers 54 and 62 face away from the interior region of cup holder 10 in the fully opened orientation. The outer surface of cup holder 10 is defined by outer surface 39 of panels 24, 26, 28, 30, 32, 34, and 36 and outer surface 39 of first and second regions 18 and 20 specifically the outer surfaces 39 of base areas 56, 64, 86 and 90.

The resultant design of cup holder 10 provides a number of benefits. The pattern 12 used to create cup holder 10 as outlined above is formed from a single piece of material which can be formed with a single die or multiple dies to create the necessary shape and creases. In one embodiment the die can also form embossments on the panels of 24, 26, 28, 30, 32, and 34 to aid in the thermodynamic and ergonomic properties of cup holder 10. The embossed regions provide a non-uniform outer surface to aid in a user gripping the cup holder. The term non-uniform as used herein means that the outer surface is not completely smooth. In one embodiment, some portions of the surface of sleeve 10 are raised while others portions are not. In this manner the surface is non-uniform. It is contemplated that the embossed regions may have a similar pattern throughout the surface of the sleeve 10 and it is also contemplated that the embossed regions may not have a similar pattern throughout the surface. In yet another embodiment, the embossed regions may be random or be a familiar design such as a logo of a company and/or sports team by way of example. The embossed regions also provide a separation from the hot or cold beverage in a cup within the cup holder so that heat transfer to a user's hand from the temperature of the cup is minimized. In one embodiment the embossed regions create undulating or spaced parallel raised regions that act to trap air between the cup within the cup holder and the cup holder itself that increases the overall insulation of the beverage within the cup that is located within the cup holder.

In one embodiment a "sized" paper material includes components that improve moisture holdout. In one embodiment the paper is polycoated on one side or on both sides. Additionally, in one embodiment the materials used contains absorptive properties to quickly absorb any moisture generated by a beverage or other container. Further, in one embodiment the materials are recyclable or made of post consumer material so when disposed of the impact on the environment is minimized. In one embodiment, materials used provide insulating properties to keep the beverage cold by the application of a biodegradable foam on a paperboard substrate or through a corrugated or embossed paperboard with a wax coating that traps air and prevents materials from losing their structural integrity due to the condensation that is produced. However other materials known in the art may also be used.

Cup holder 10 may be shipped in a flat configuration such that the only assembly required for a user is to squeeze the sides of the flattened pattern. No additional assembly is required upon receipt by a user. The two base portions 18 and 20 automatically interlock with one another as a user simply squeezes the outer portion of the panels as discussed above.

The six sided cup holder that results from the assembly as outlined above provides for a general conical shape such that the general cross-sectional area proximate the base portion is smaller than the general cross-sectional area near the top portion or top edge of the panels. The cross-sectional area is defined by a plane that is perpendicular to a vertical linear access that would be perpendicular to the base portions 18 and 20 in the fully opened and interlocked orientation.

Referring to FIG. 15A-15G, embossing designs are illustrated. In one embodiment the embossing design includes an offset of the sleeve. The subtle offset of the sleeve from the cup allows for minimal surface contact directly with the outer surface of the cup, which creates air gaps. These air gaps aid in reducing heat transfer to and from the users hand and its surroundings. Some embodiments of the embossing designs trap air which functions to a higher level of creating a 'double pane' glass effect to insulate the interior material (i.e. liquid) and increase the time for the interior material to reach equilibrium with its surroundings (temperature). Through the detailed embossing low relief angles are created on a previously flat surface that increases material strength. The embossing treatment adds a tactile element to the multitude of faceted sides that increases grip ability and enhances the feel and look of material. For marketing purposes, embossing may be used to further brand the sleeve through visual and tactile elements.

The folding design allows for bottom of sleeve to be covered by overlapping flaps to ensure liquid condensation does not come in contact with surroundings. User interaction of sleeve is to be fully opened by squeezing either edge of the closed sleeve with one hand for easy insertion of cup with other hand.

Cup holder 10 has a hexagonal shape that conforms to various sized cups of different shapes and/or diameters to accommodate different diameter bases of cups. Initial surface contact points for the interior of the sleeve and outer surface of cup creates a snug fit as to not fall off, i.e. use of sleeve within an automotive interior cup holder environment. In one embodiment the cup that may be held within cup holder 10 has a frusto-conical shape. However other shapes may also be held within cup holder 10.

Asymmetrical sides of the design create an ergonomically intuitive presence on the rather stagnant sleeves available today. Further, the asymmetrical design allows for maximum hand contact while still maintaining proper space for existing branding on cups.

This sleeve provides a cost effective and pointed solution to the unnecessary waste of discretionary, indirect materials (napkins, double cups, ineffective sleeves) therefore providing a higher profit margin for the vendor of cold beverages and reducing the habit of consumers using alternative solutions such as using napkins, double cups, or ineffective sleeves.

Figure 20:
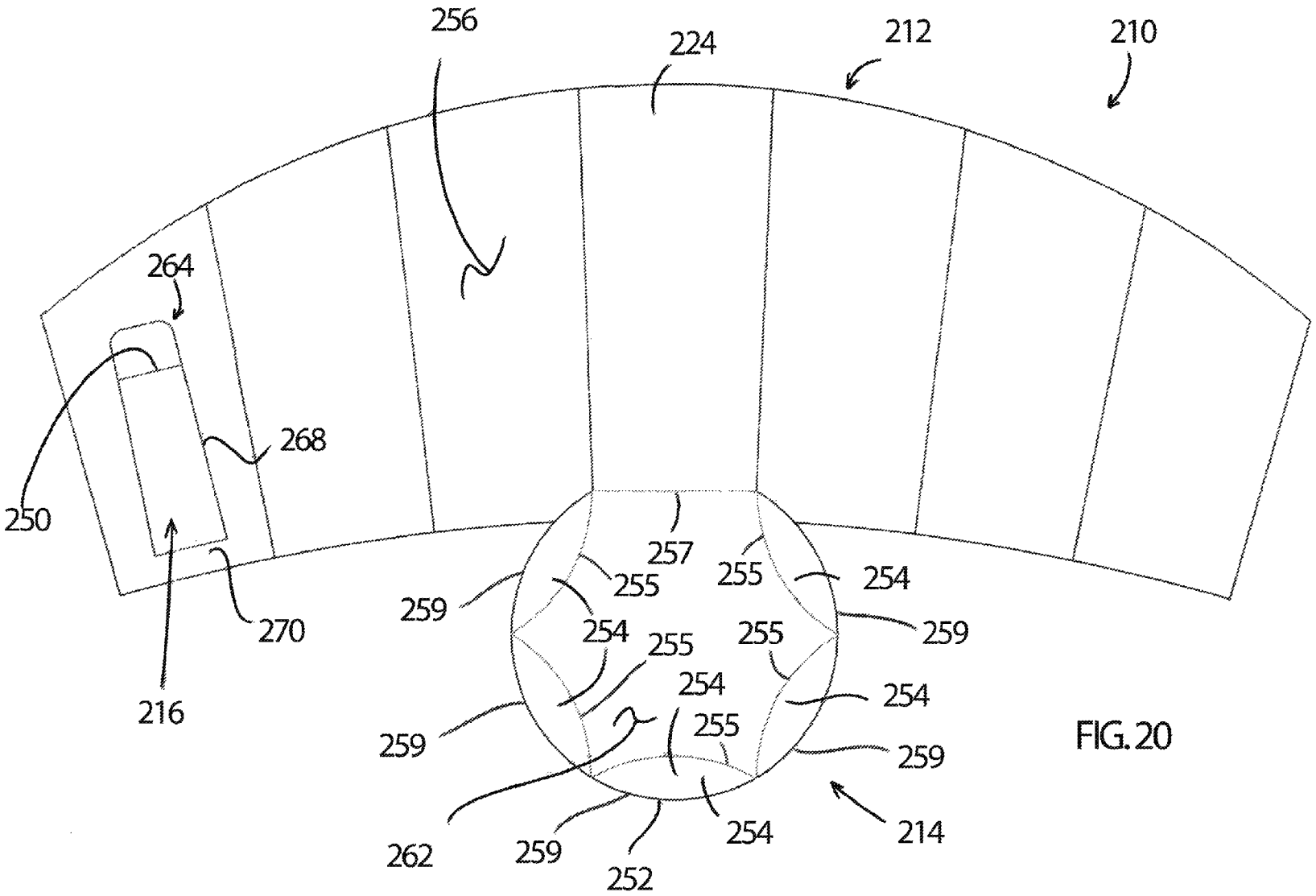
FIG. 20 is a view of a die cut material in a flat unassembled position.
Figure 21:
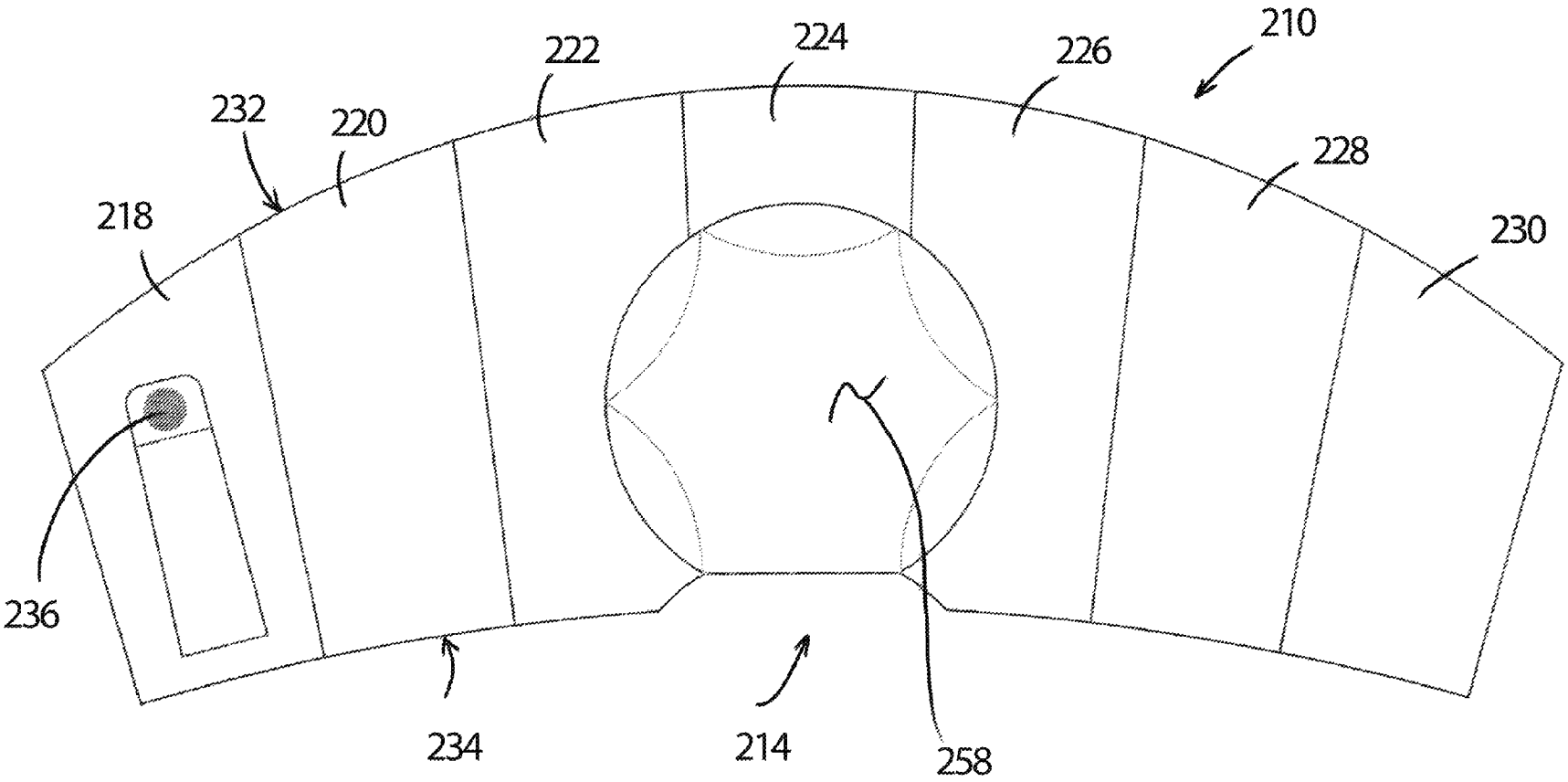
FIG. 21 is a view of the die cut materials of FIG. 20 with a bottom portion in a folded position.
Figure 37:
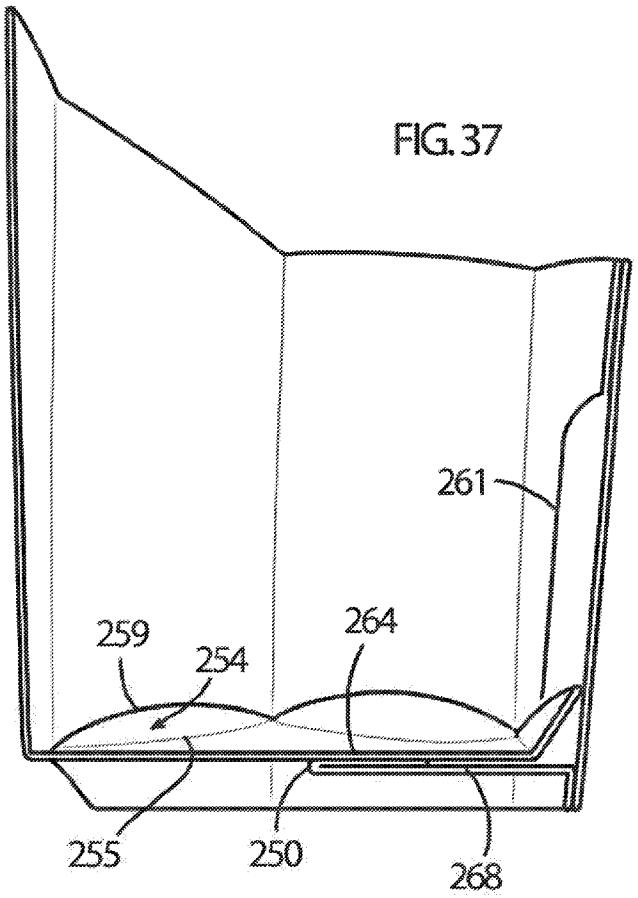
FIG. 37 is a cross sectional view cross sectional view taken generally along line 36-26 of FIG. 28 in an-in use orientation illustrating the manner in which the coaster is press fit against the body portion and how the tongue extends from the side panel and is secured to the coaster portion.
Figure 36:
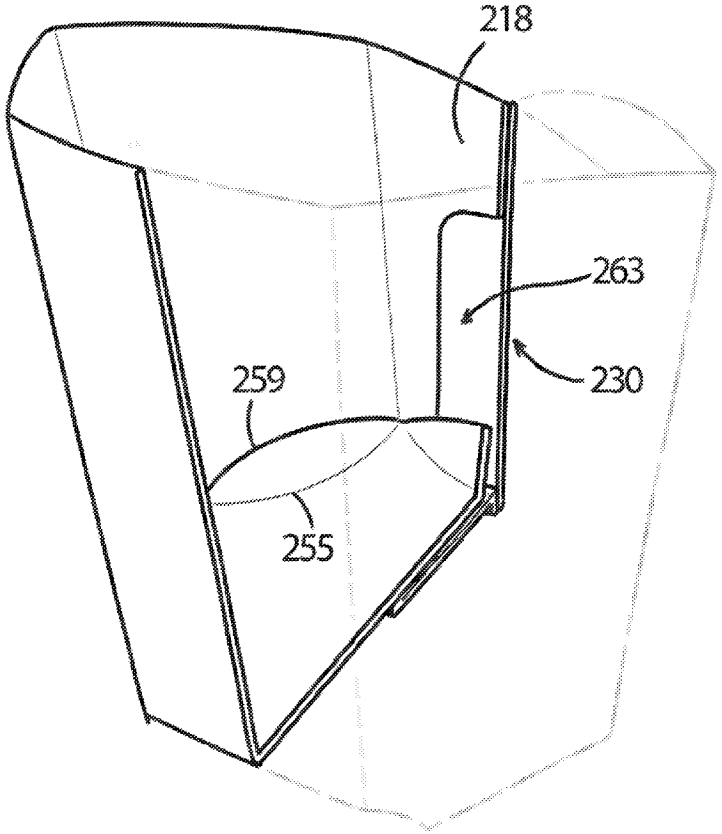
FIG. 36 is an isometric cross sectional view cross sectional view taken generally along line 36-36 of FIG. 28 in an-in use orientation illustrating the manner in which the coaster is press fit against the body portion and how the tongue extends from the side panel and is secured to the coaster portion.

Referring to FIGS. 20-25F a die cut material is formed into a folded orientation and then into an open position. Referring to FIGS. 20 and 21 a die cut material 210 includes a body portion 212 and a bottom portion 214. Body portion 212 includes a plurality of sections 218, 220, 222, 224, 226, 228 and 230 defining an upper arcuate edge 232 and a lower arcuate edge 234. Panel 218 includes a tongue 216 having a top portion 264 and a bottom portion 268 separated by a fold line 250. Tongue 216 is secured to panel 218 proximate end 270 of bottom portion 268. Tongue may be a separate piece and secured to panel 218 proximate bottom 268 or may be integrally formed with panel 218 and separated from panel 218 as part of the formation of die cut material 210. Referring to FIG. 36 and FIG. 37 the tongue is removed from panel 218 such that it leaves an opening 263 in panel 218 having a border 261 when the tongue is bent along a bottom crease. However the opening 263 is covered by panel 230 in the in-use fully assembled orientation discussed herein.

Figure 22:
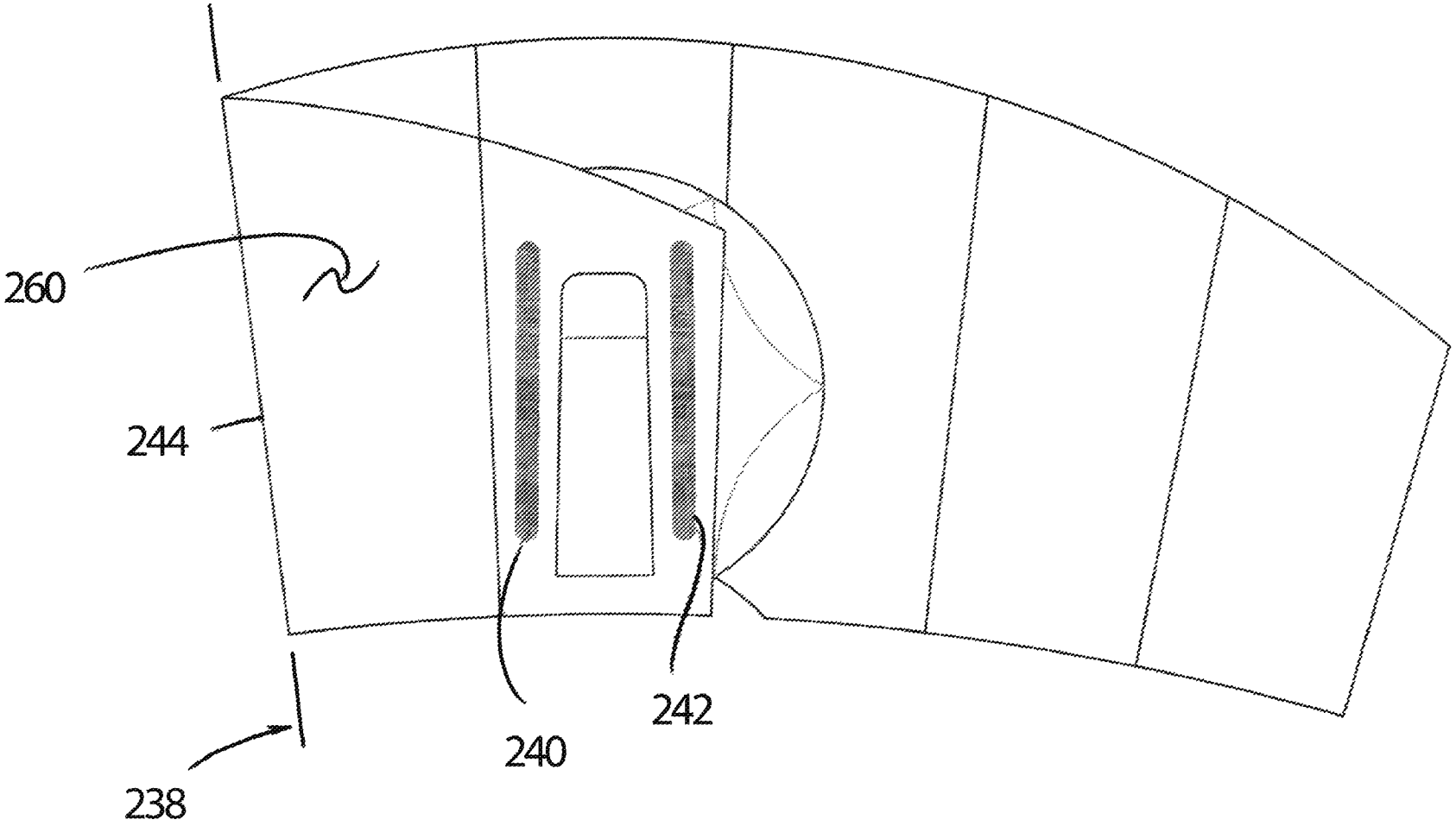
FIG. 22 is a view of the die cut material of FIG. 21 with a first and second body portion in a folded position.

Referring to FIGS. 20 and 21 an adhesive material 236 is applied to top portion 264 of tongue 216. Bottom portion 214 is rotated upward toward body 210 such that inner surface 262 of bottom portion 214 is adjacent inner surface 256 of body portion 210. Referring to FIG. 22 panels 218 and 220 are rotated about line 244 along axis 238 such that the inner surfaces of panels 218 and 220 are adjacent bottom 214, panel 224 and panels 222. First portion 264 is adhesively secured to the outer surface of bottom 214 by adhesive 236.

In one embodiment the panels are separated on the body portion by a score line which may be a continuous crease or perforations that are spaced from one another and extend partially way through the blank.

Figure 23:
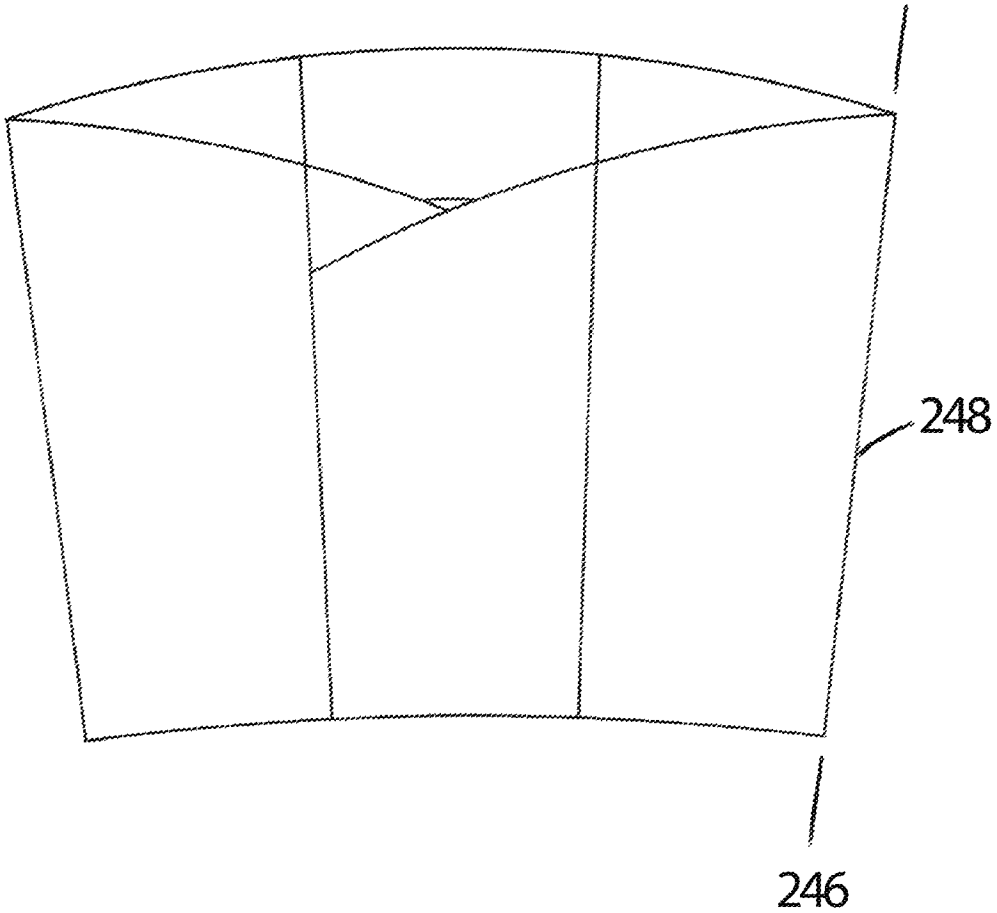
FIG. 23 is a view of the die cut materials of FIG. 22 with a sixth and seventh portions in a folded position.

Adhesive materials 240 and 242 are applied to the outer surface 260 of panel 218 proximate sides of tongue 216. Referring to FIG. 23 panels 230 and 228 are rotated about line 248 along axis 246 such that the interior surfaces of panels 230 is adhesively connected to panel 218 along adhesive portions 240, 242.

Figure 24:
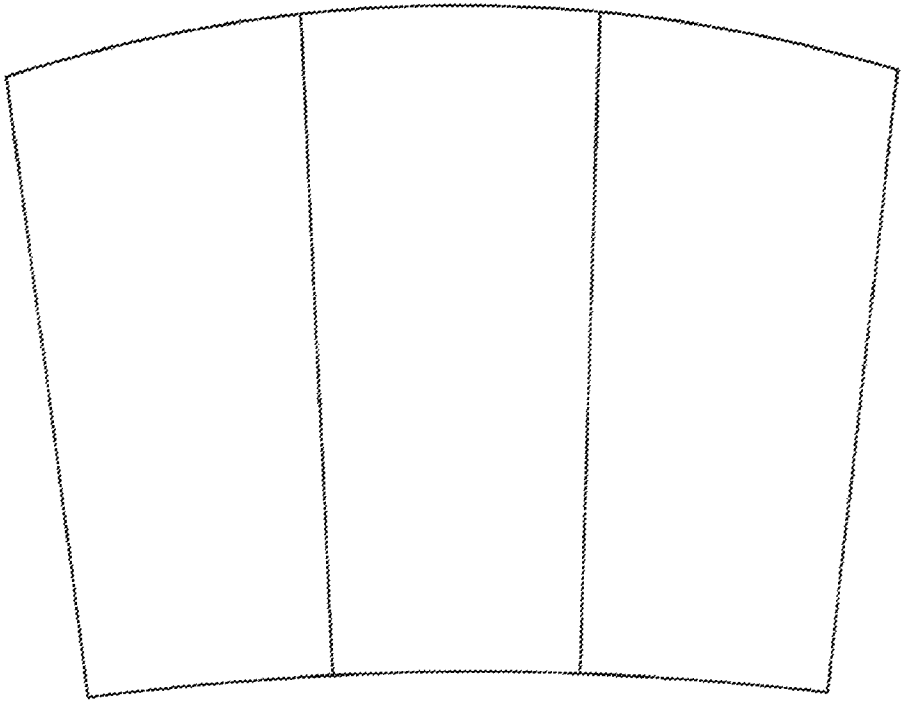
FIG. 24 is a rear view of the die cut materials of FIG. 23 showing body the third, fourth and fifth body portions.

Referring to FIG. 24 the outer surfaces of panels 222, 224 and 226 are illustrated. Referring to FIGS. 25A- 25F the opening of the folded sleeve 210 is illustrated. A user applies pressure to lines 244 and 248 toward one another. As a result panels 218, 220, 222, 224, 226, 228 and 230 all move away from one another. Bottom 214 is pulled in a direction from upper edge 232 toward lower edge 234. Tongue first portion 264 that is adhesively secured to bottom 214 becomes adjacent to bottom portion 268 of tongue 216 as bottom 214 is moved to the fully lowered position as illustrated in FIG. 25F. Portions 254 of bottom 214 fold upwardly toward upper edge 232 and are adjacent to respective panels 218, 220, 222, 224, 226, and 228. In this manner die cut material 210 is formed into a useful vessel and/or sleeve. This sleeve provides many benefits to an end user.

Portions 254 include an outer periphery portion that forms the outer periphery 252 of bottom 214. Portions 254 include an inner arcuate crease 255 about which portions 254 flex. In one embodiment arcuate crease 255 is formed by a series of perforations that are spaced apart and extend at least partially thought the coater portion. In one embodiment arcuate crease 255 is a score that is continuous and extends at least partially into the coaster portion. In one embodiment arcuate crease 255 is formed a combination of a score and a perforation. As the sleeve is formed into a cup holder and the outer periphery 259 of portions 254 engage the panels of body portion 212 the bottom or coaster 214 is press fit against the body portion 212. The arcuate line 255 allows the coaster to bend in a manner to allow the coater to be press fit against the body portion about the periphery of the coaster.

Figure 25:
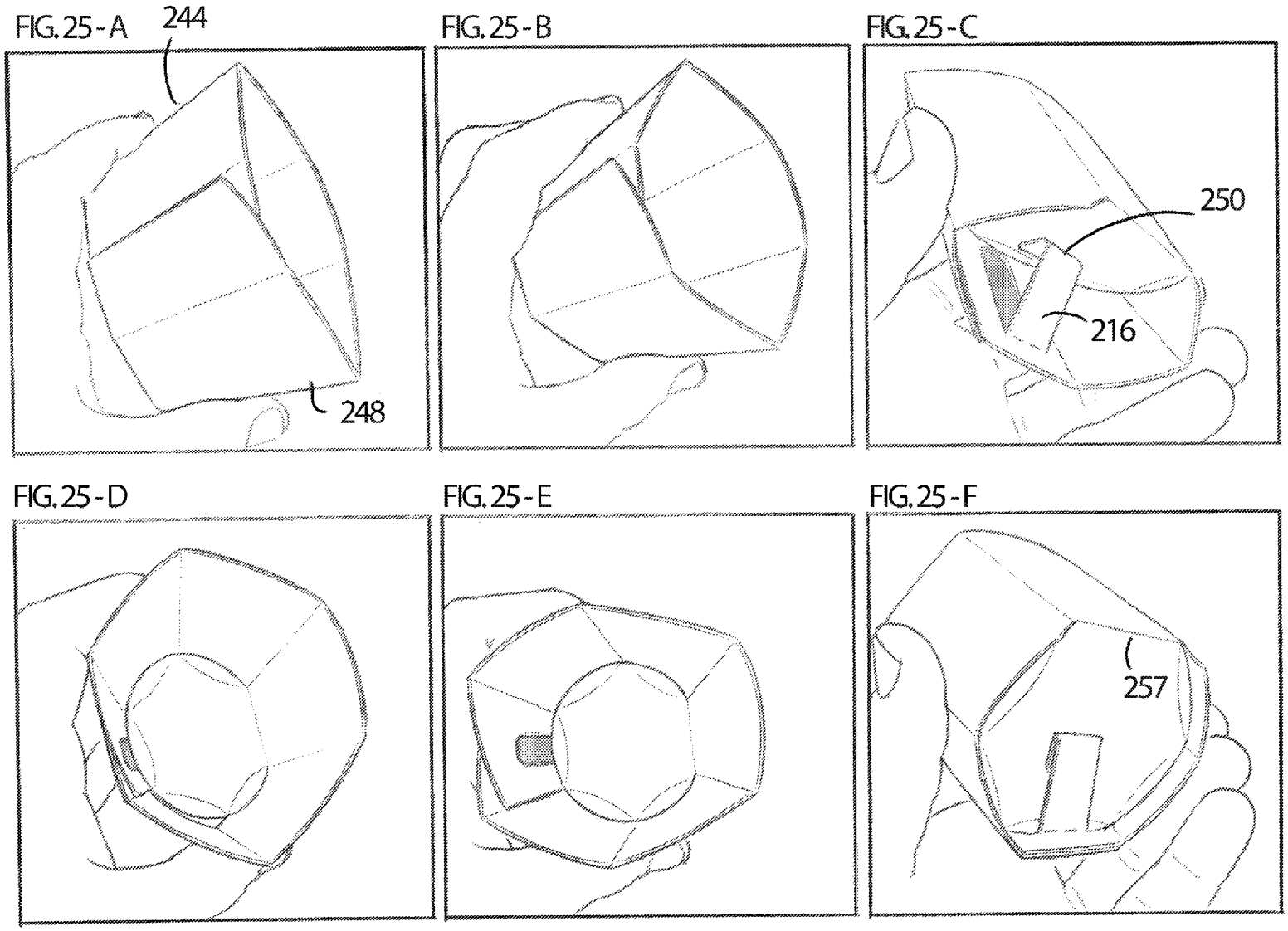
FIG. 25A is a first view of a user beginning to move the folded die cut material of FIG. 18 is a folded position.
FIG. 25B is a second view of the user moving the folded die cut material of FIG. 25A to the folded position.
FIG. 25C is a bottom isometric view of the user moving the folded die cut material of FIG. 25A to the folded position in which a tongue engages an aperture on the bottom portion.
FIG. 25D is a top isometric view of the user moving the folded die cut material of FIG. 25A to the folded position.
FIG. 25E is a top view of the folded die cut material in the open non-folded position.
FIG. 25F is a bottom isometric view of the die cut material in the open non-folded position with the tongue fully engaged with the bottom portion.
Figure 26:
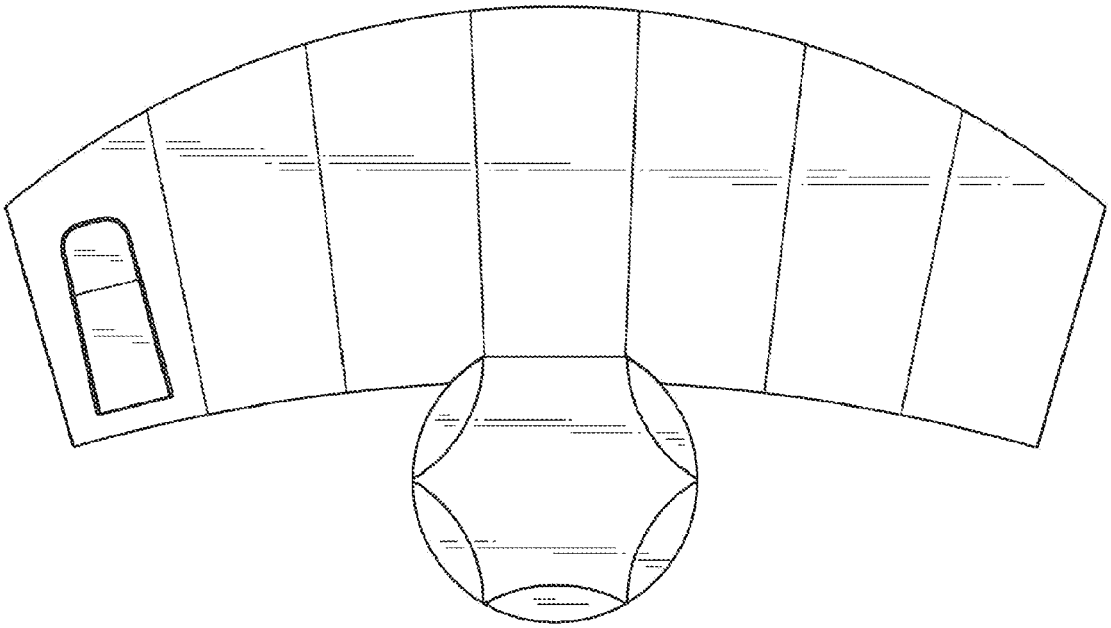
FIG. 26 is a design of the blank of FIG. 20.

Referring to FIG. 20 a portion of coaster 214 proximate center panel 224 does not have a free outer periphery as it extends from panel 224 along line 257. Referring to FIG. 21 and FIG. 25-F bottom or coaster 214 is positioned a predetermined distance away from the lower arcuate edge 234 of body portion 212 along a vector toward upper arcuate edge 232. The space between the bottom 214 and lower arcuate edge 234 provides space for tongue 216 to be located and support and locate bottom 214. The space created between bottom 214 and lower arcuate edge 234 provides for a stable location of the cup sleeve when it is placed on a planar surface such as a table.

Figure 35:
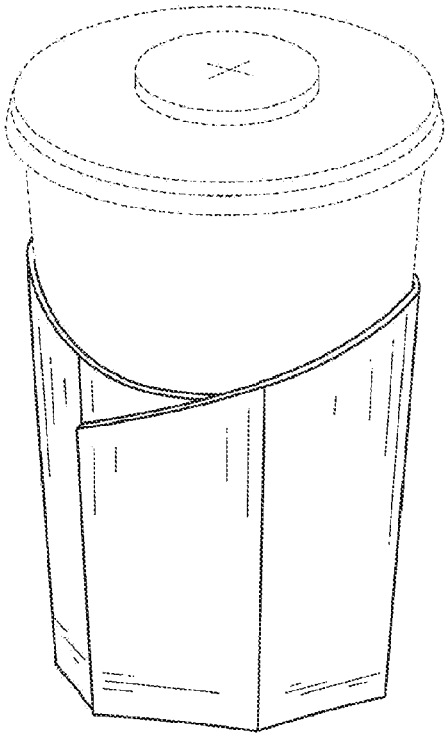
FIG. 35 is an isometric view of the blank of FIG. 26 in an-in use orientation as shaped with a conical cup located therein. The dashed lines represent a cup having a conical shape.
Figure 27:
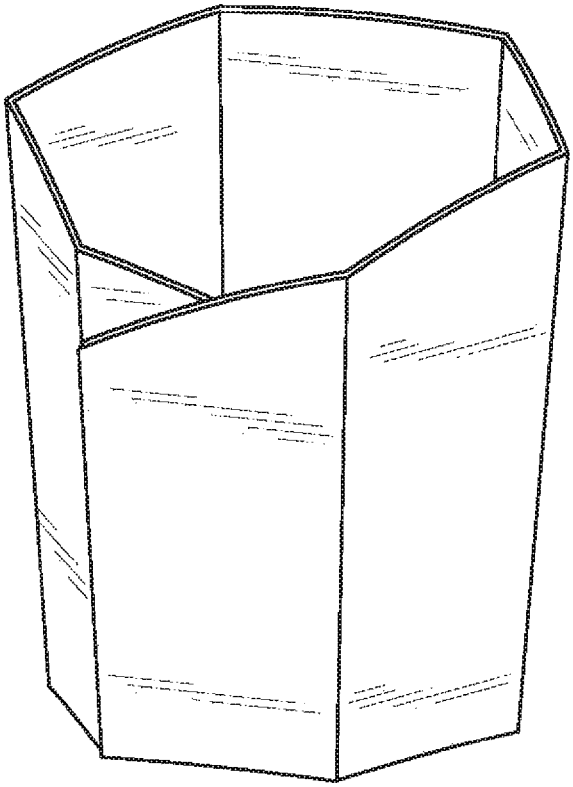
FIG. 27 is a top isometric view of the blank of FIG. 26 in an in-use orientation.
Figure 28:
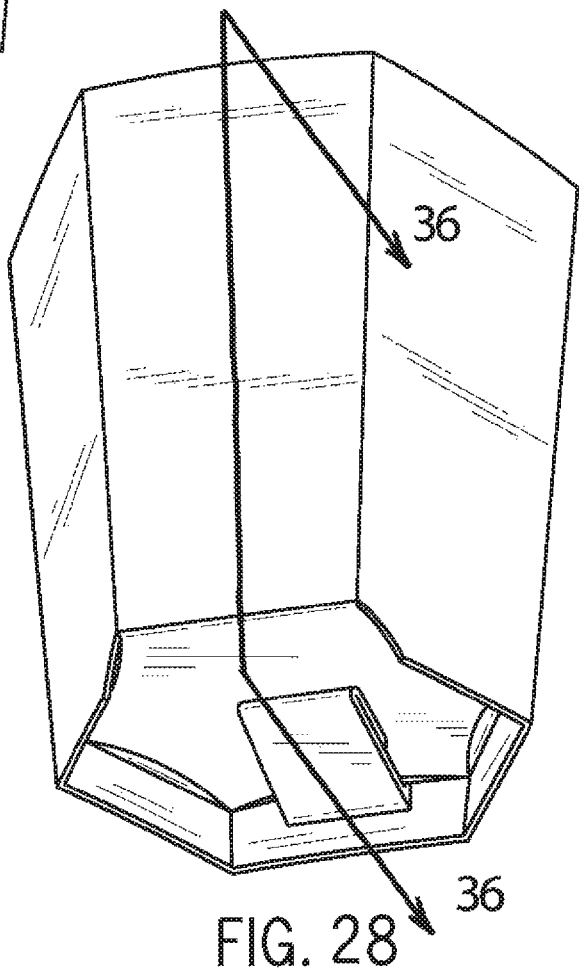
FIG. 28 is a bottom isometric view of the blank of FIG. 26 in an in-use orientation.
Figure 29:
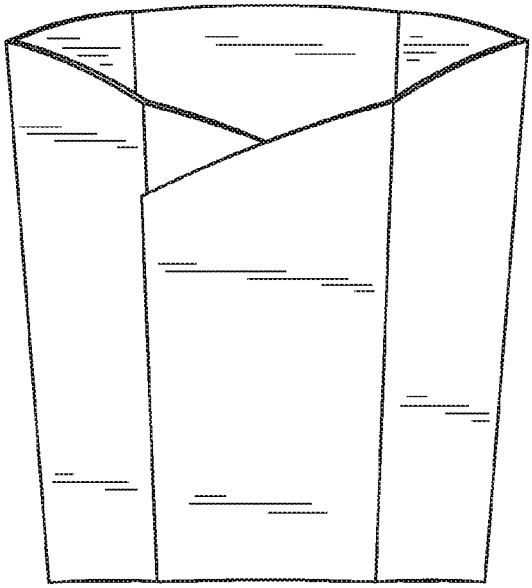
FIG. 29 is a front view of the blank of FIG. 26 in an in-use orientation.
Figure 30:
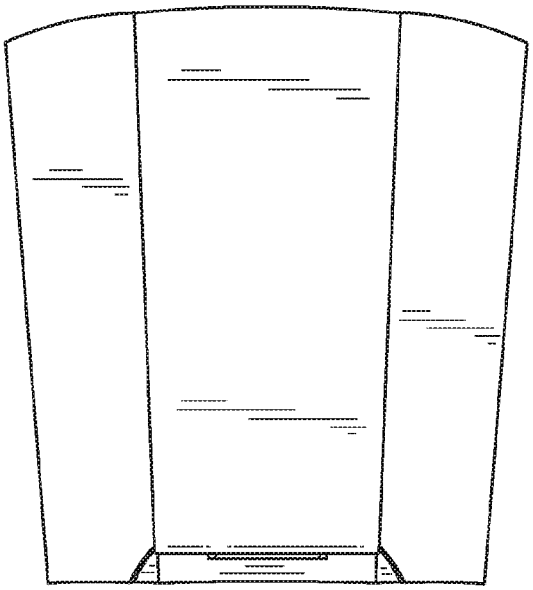
FIG. 30 is a rear view of the blank of FIG. 26 in an in-use orientation.
Figure 31:
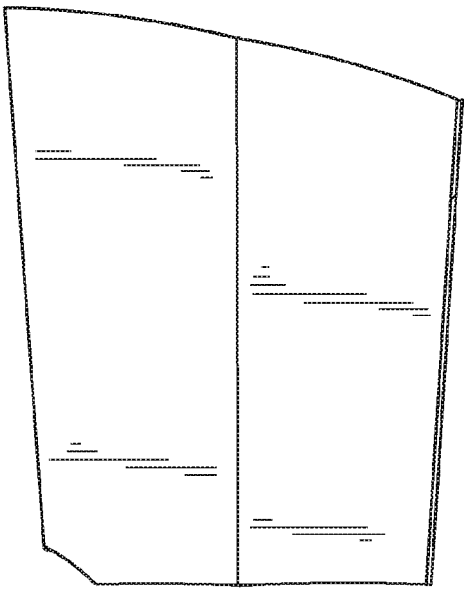
FIG. 31 is a left view of the blank of FIG. 26 in an in-use orientation.
Figure 32:
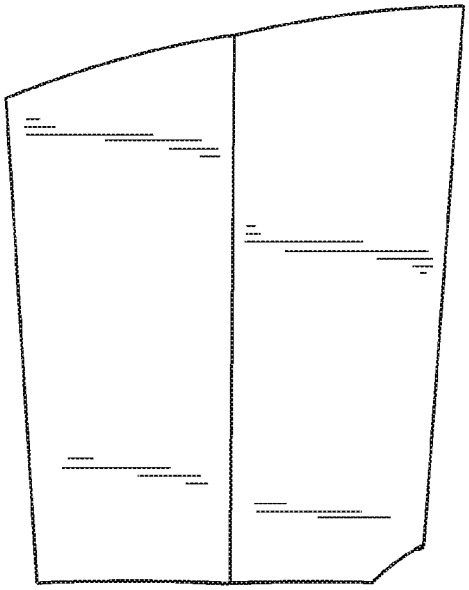
FIG. 32 is a right view of the blank of FIG. 26 in an in-use orientation.
Figure 33:
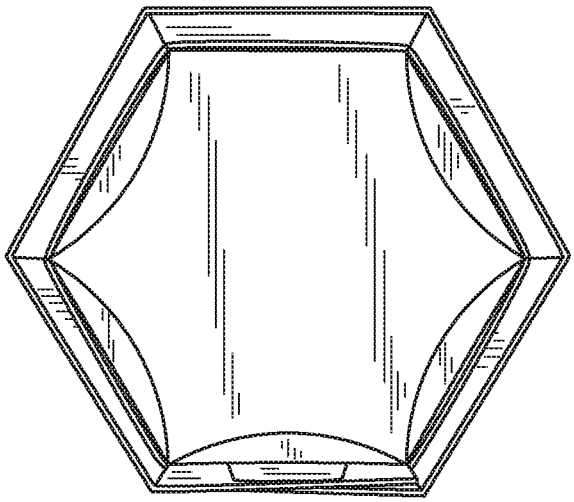
FIG. 33 is a top view of the blank of FIG. 26 in an in-use orientation.
Figure 34:
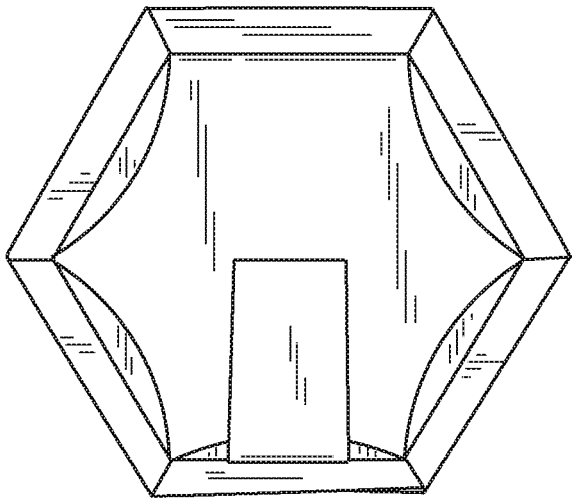
FIG. 34 is a bottom view of the blank of FIG. 26 in an in-use orientation.

Referring to FIG. 21 and FIG. 35 the upper arcuate edge 232 assumes the shape of a conical shaped when the cup is placed within the sleeve. Such that the transition between panels 218, 220, 222, 224, 226, 228, and 230 proximate the upper actuate edge 232 are smoothed from a hard transition to more of an arcuate transition. In contrast, in one embodiment the transition between panels 218, 220, 222, 224, 226, 228, and 230 proximate the lower arcuate edge 234 retains a hard crease where the transition is not arcuate but having a distinct angle.

In one embodiment the sleeve is conical and hexagonal shaped that allows one sleeve to fit a cups that are of different sizes (universal sleeve). The hexagonal shape of the side walls function to hold the cup tightly as to eliminate the sleeve from falling off or away from said cup. Referring to FIG. 35 when a conical cup is placed within a cavity defined by the sleeve, the upper arcuate edge of the body portion conforms to the shape of the conical cup and wherein a lower arcuate edge of the body portion has a six sided non-arcuate shape. In one embodiment the conical cup has a generally cylindrical shape with a base, wherein the coaster supports the base of the cup. In one embodiment the conical cup is any member having a conical shape that changes the upper arcuate edge from having distinct sides with angles at the transition or crease lines to a having a more conical shape that generally conforms to the conical shape of the conical member or cup.

The apparatus described herein provides for easy manufacturing for this type of fully enclosed sleeve that has a fully enclosed bottom or coaster. In one embodiment a single bottom piece needs to be folded into the body, then gluing occurs and the body is folded to form the sleeve in a flat presentation. The design provides for a simple and efficient means for manufacture.

In one embodiment when the die cut materials transitions from a flat state to an open state, the bottom flap is simultaneously pulled down by a tab that is formed as part of a vertical side wall that is opposed to the bottom edge. This tab creates the torque to pull the bottom flap shut, therefore creating a sealed bottom.

In one embodiment the bottom flap of the sleeve has a greater diameter than the base of the sleeve and includes a pinched oval scoring design which allows the edges of bottom to grip the walls of the sleeve when opened. This feature will fully enclose the bottom and fully seal the sleeve's bottom from its surroundings. This scoring design in the bottom also creates an area to collect condensation and prevent condensation from leaking out. Additionally, the scoring design allows the bottom to grip the cup when inserted by the end user.

In one embodiment the bottom is a distance from the bottom edges of the body portion toward the top edges of the body portion. In this manner the bottom is raised from bottom edges of the body of the sleeve. This feature helps to stabilize the sleeve when a cup is inserted. The raised bottom also prevents the bottom from being pushed outside of the body and/or beyond the bottom edges of the body portions when a cup is inserted.

The six corners of the hexagonal side wall with but not limited the addition of embossing detail to the sleeve function as gutters for excess condensation build up. Funneled water is then captured by the novel bottom flap and contained by the side walls.

Figure 38:
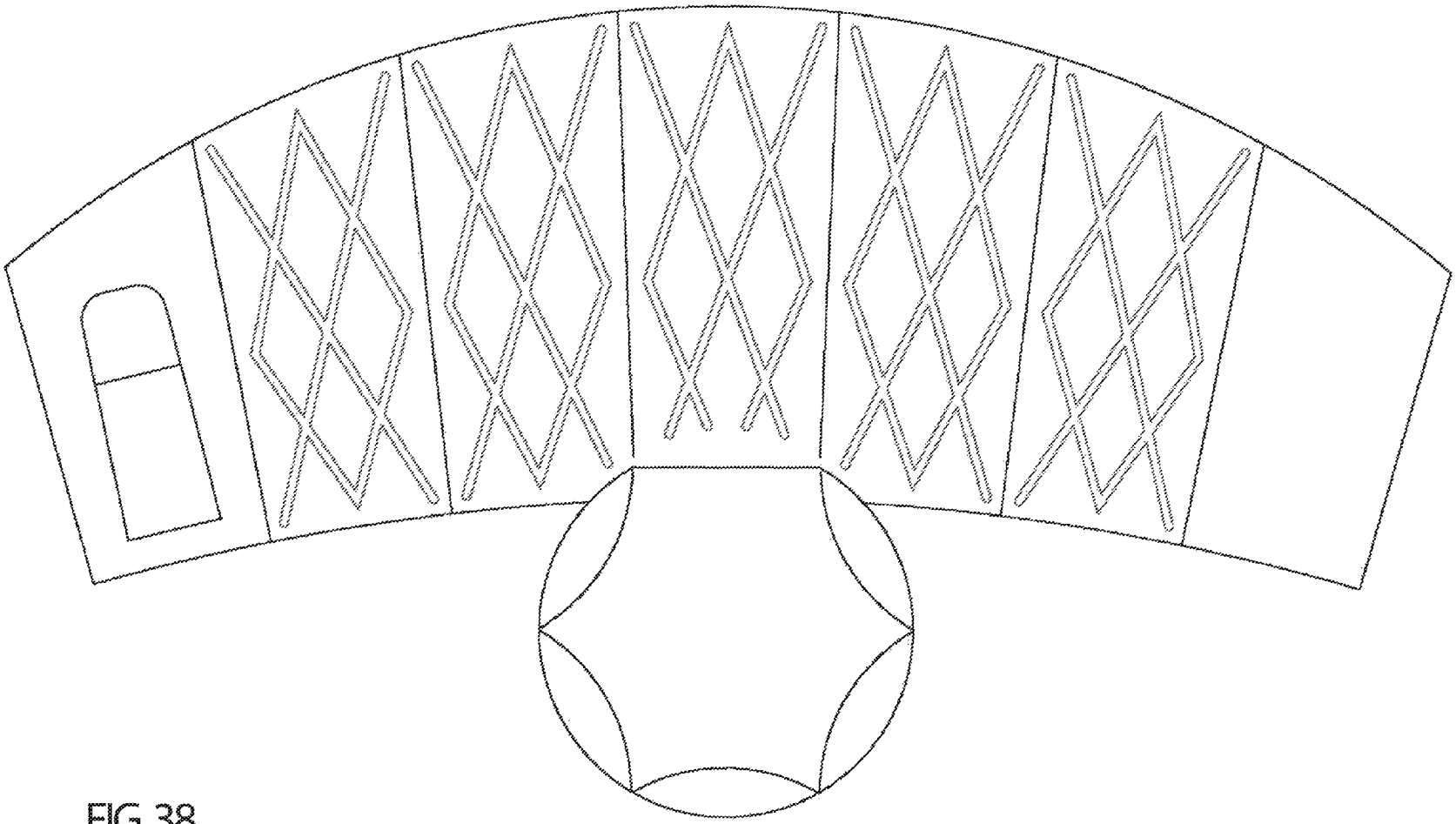
FIG. 38 is the design blank of FIG. 20 with an embossed pattern.
Figure 39:
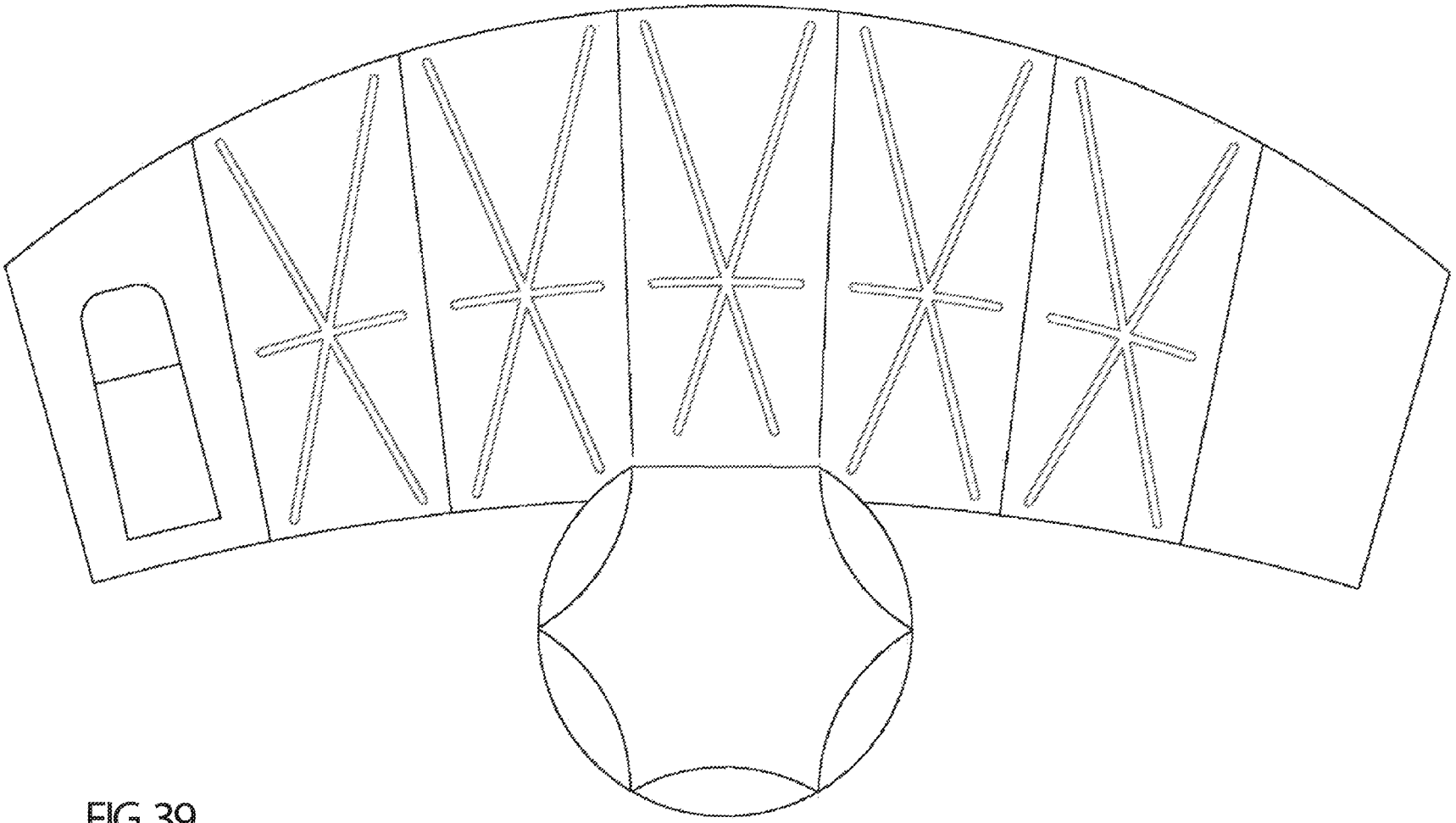
FIG. 39 is the design blank of FIG. 20 with an embossed pattern.
Figure 40:
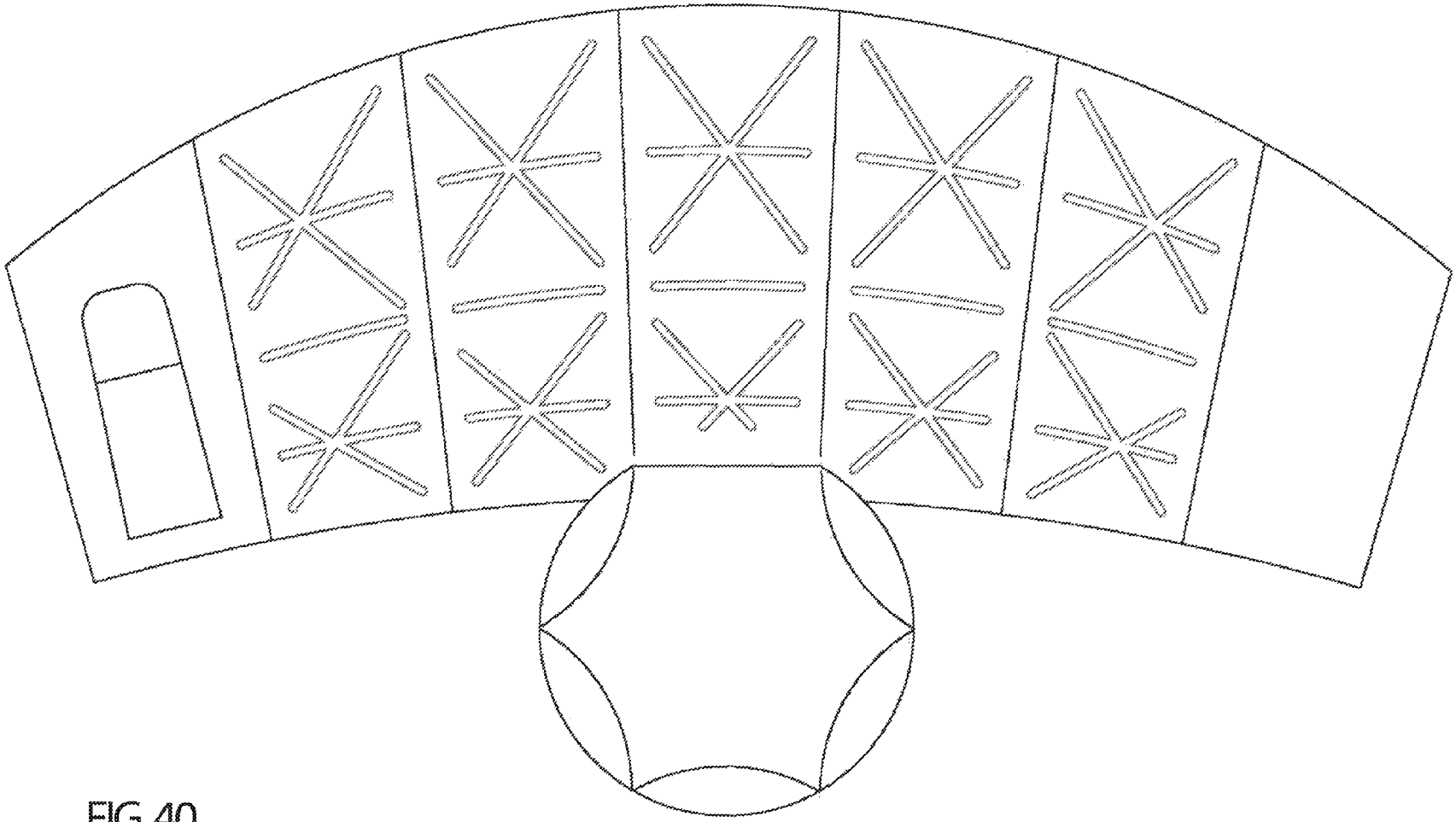
FIG. 40 is the design blank of FIG. 20 with an embossed pattern.
Figure 41:
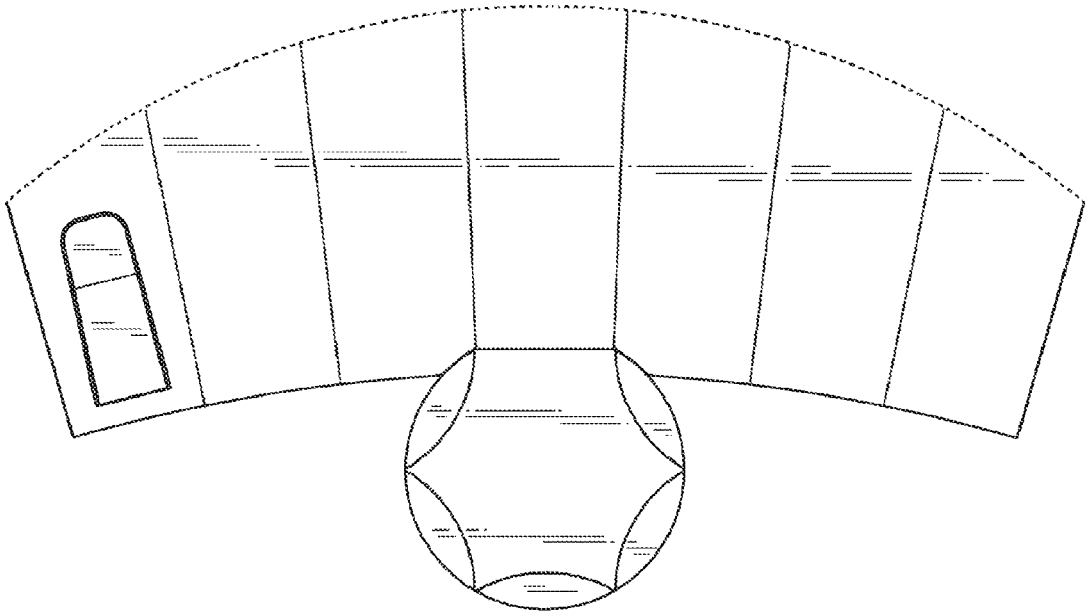
FIG. 41 is a design of the blank of FIG. 20 having an upper edge in dashed lines showing that the upper line may have a different shape.
Figure 50:
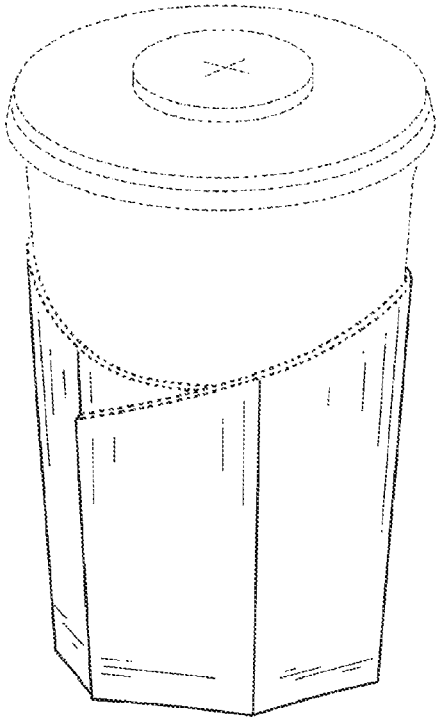
FIG. 50 is an isometric view of the blank of FIG. 41 in an-in use orientation as shaped with a conical cup located therein. The dashed lines represent a cup having a conical shape.
Figure 42:
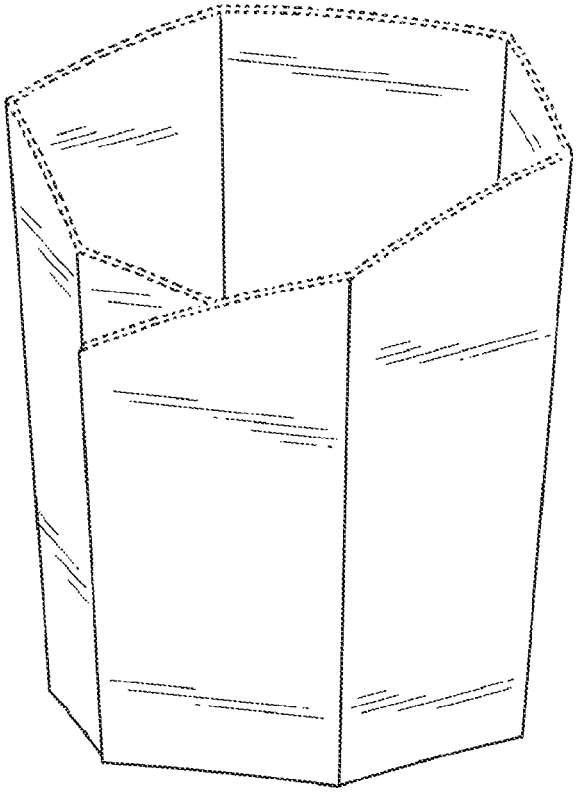
FIG. 42 is a top isometric view of the blank of FIG. 41 in an in-use orientation.
Figure 43:
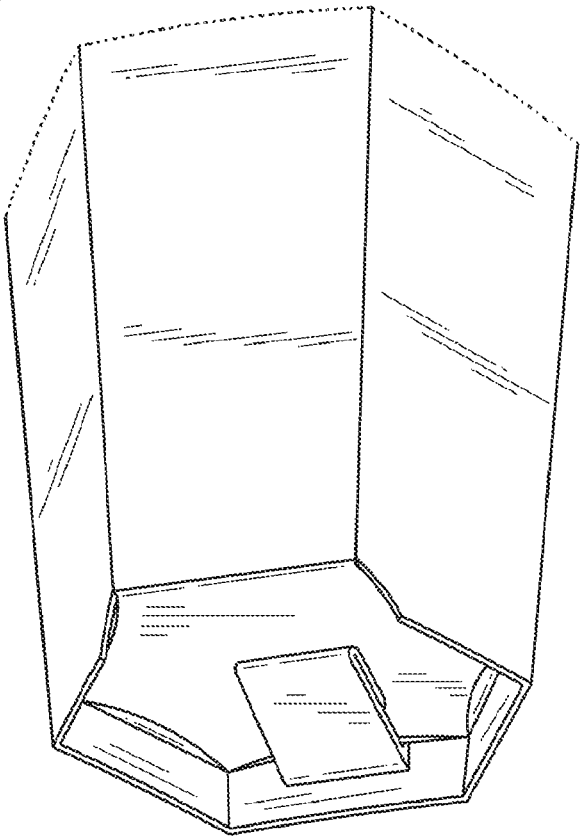
FIG. 43 is a bottom isometric view of the blank of FIG. 41 in an in-use orientation.
Figure 44:
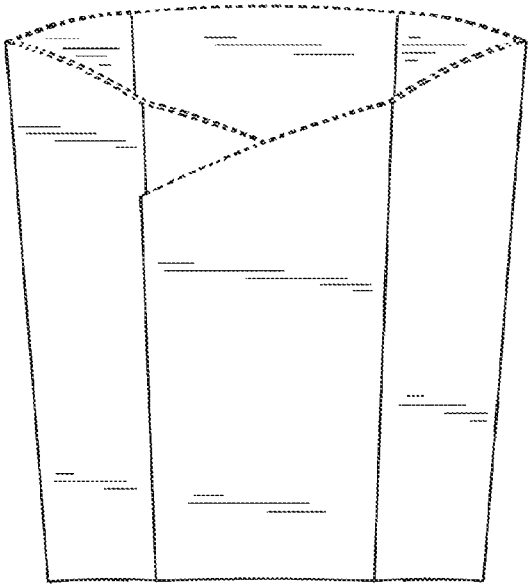
FIG. 44 is a front view of the blank of FIG. 41 in an in-use orientation.
Figure 45:
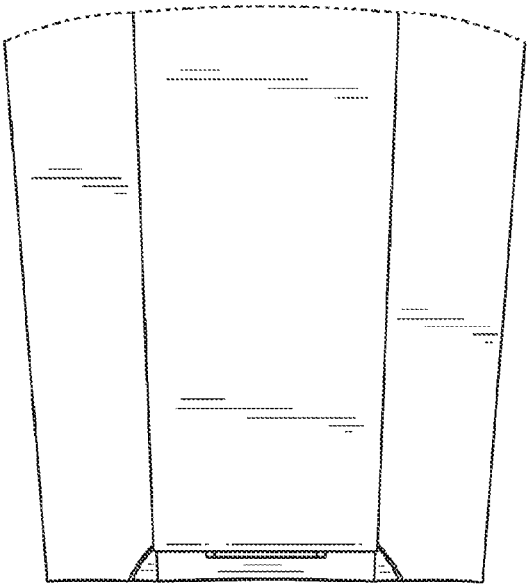
FIG. 45 is a rear view of the blank of FIG. 41 in an in-use orientation.
Figure 46:
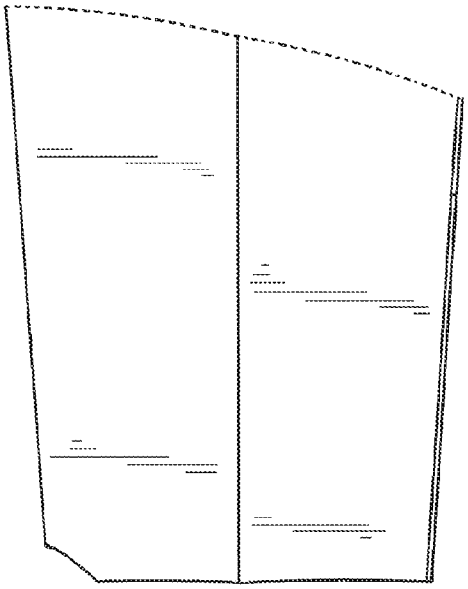
FIG. 46 is a left view of the blank of FIG. 41 in an in-use orientation.
Figure 47:
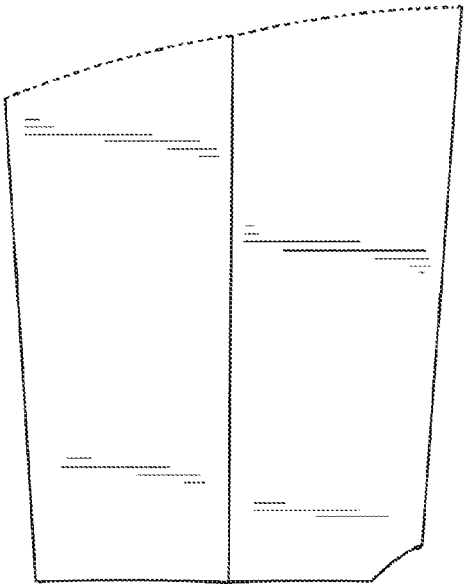
FIG. 47 is a right view of the blank of FIG. 41 in an in-use orientation.
Figure 48:
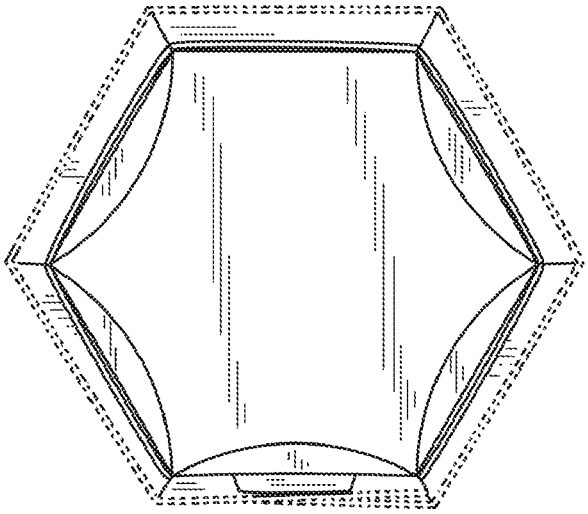
FIG. 48 is a top view of the blank of FIG. 41 in an in-use orientation.
Figure 49:
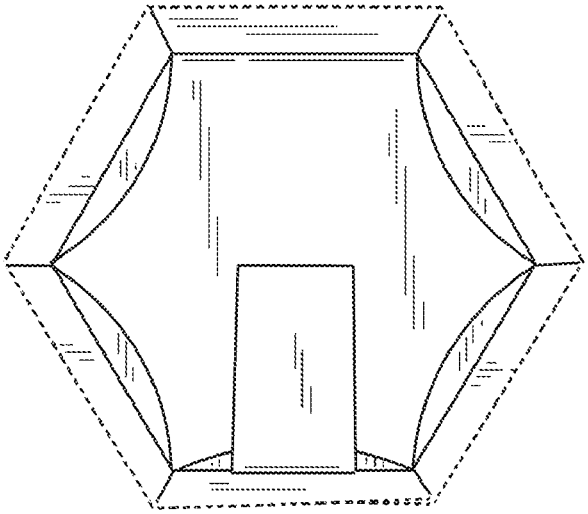
FIG. 49 is a bottom view of the blank of FIG. 41 in an in-use orientation.

The embossing design allows for a gap to trap air which improves insulation of hot or cold beverages. Further, this gap also directs condensation to the inside of the sleeve. Since, this sleeve is designed to fully enclose the container it holds (via the benefits described above), no water or condensation will be seen or felt on the outside of the sleeve. All emboss designs may be used with the blanks described herein including but not limited to the blank in FIG. 20. For example the emboss designs in FIGS. 38-40 may be incorporated in the blank illustrated in FIG. 20.

Referring to FIGS. 41-50 a blank design is illustrated where the upper edge is in dashed lines signifying that the upper edge may be different shapes. In one embodiment the upper edge is formed such that the upper edge is a uniform height from the table when the sleeve with coater is in an in use orientation on a table. In another embodiment the upper edge may have an undulating shape or other design that is known in the art.

Figure 16:
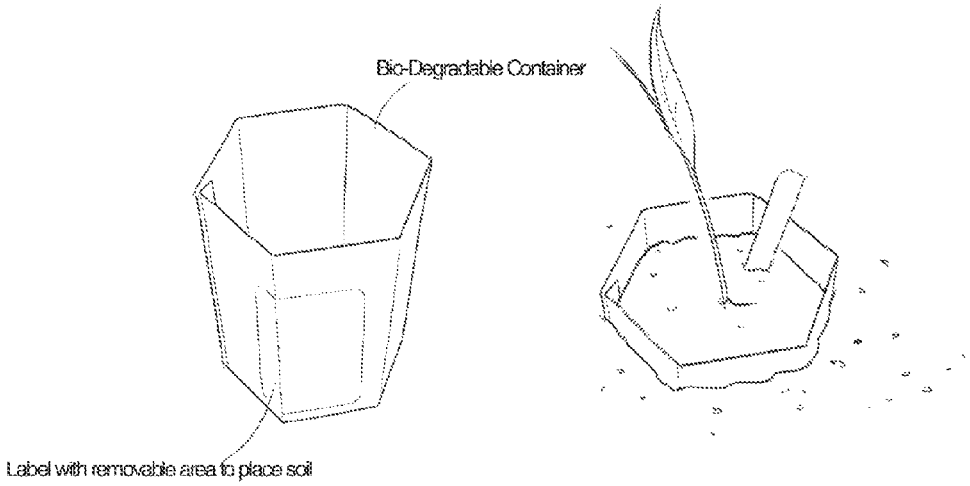
FIG. 16 is an isometric view of a bio-degradable container before and after it is planted in the ground.
Figure 17:
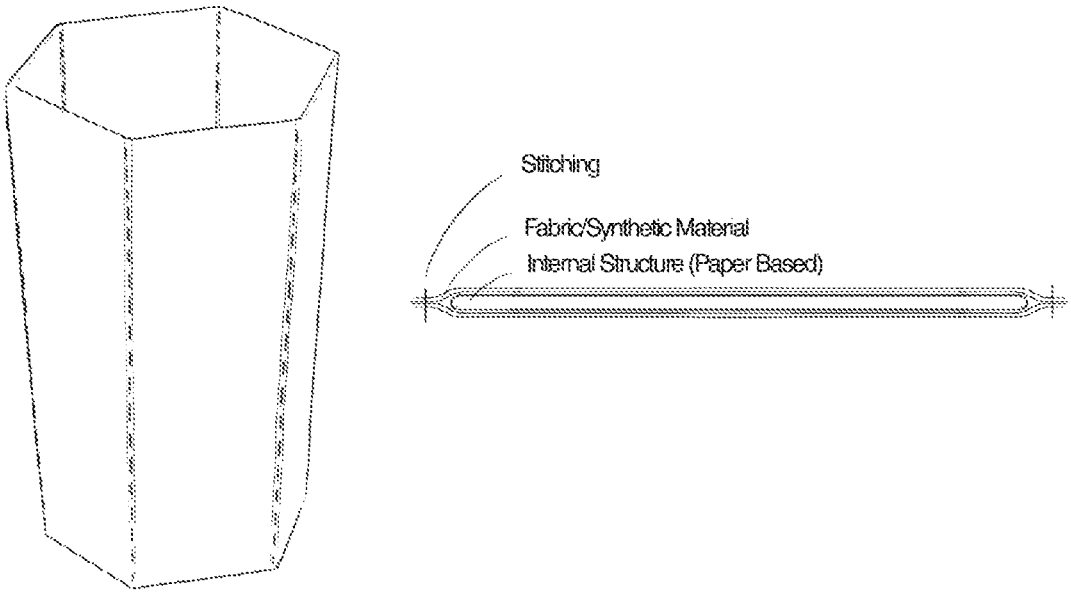
FIG. 17 is an isometric view of a fabric container.
Figure 18:
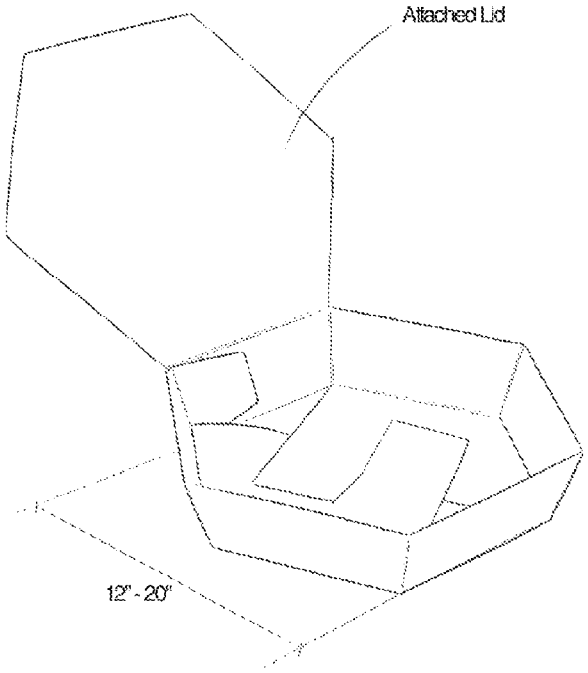
FIG. 18 is an isometric view of a container in the assembled position with an attached lid.
Figure 19:
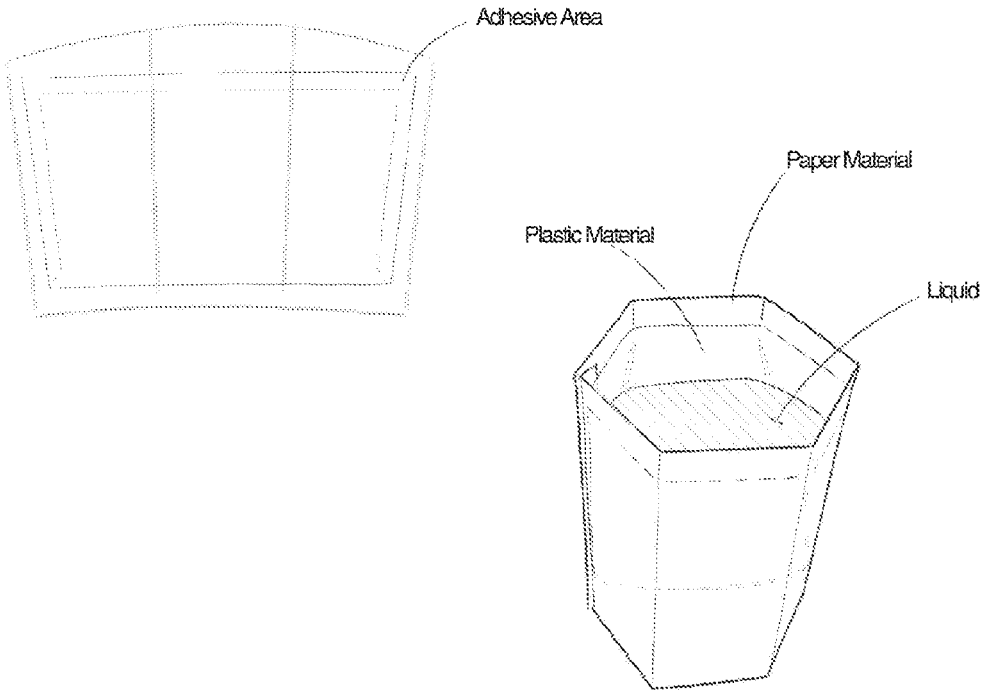
FIG. 19 is a view of a container with a plastic material in a first folded position and a second open position.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. For example although the embodiments are described as a cup holder or container, the cup holder or container may be a sleeve for hot beverage and/or a cold beverage. The sleeve may also be used for a cup including iced coffee or any iced beverage. Referring to FIG. 16 the cup holder or container could also be a potting plants receptacle that in one embodiment is composed of a bio-degradable material. Referring to FIG. 17 a container is formed from a fabric material with sewn edges (replacing the folded version) that can be used as a flat pack laundry/storage receptacle. Referring to FIG. 18 the cup holder or container could be a box for holding a cake, pie or pizza. Referring to FIG. 19 in one embodiment the cup holder or container includes a plastic bag that would be adhered to the inside of the body potion. The invention should therefore not be limited by the above described embodiment, method, and examples, but by all embodiments and methods within the scope and spirit of the invention.

What is claimed is:

1. An apparatus comprising:

a blank having:

a body portion; and a coaster portion extending therefrom;

the coaster portion being press fit against the body portion in an in-use orientation forming a generally multi-sided sleeve the coaster forming a bottom portion of the sleeve wherein the body portion includes a lower arcuate edge and an opposing upper arcuate edge, the coaster portion being integrally formed and extending from one of the panel sections a predetermined distance from the lower arcuate edge toward the upper arcuate edge.

2. The apparatus of claim 1, wherein the multi-sided sleeve includes at least six sides.

3. The apparatus of claim 2, wherein the body potion has a plurality of crease lines defining seven panel sections and an outer periphery of the coaster portion being press fit against five of the seven panel sections in the in-use orientation.

4. The apparatus of claim 3, wherein the seven panel sections includes a first end panel that overlaps and is secured to at least one of the other six panel sections when the body panel and coaster are in an in-use orientation.

5. The apparatus of claim 1, wherein the body portion includes an integrally formed tongue member extending therefrom and having a tongue tip portion operatively secured to a bottom portion of the coaster in the in-use orientation.

6. The apparatus of claim 5, wherein the tongue includes a base portion extending from the first panel and a tip portion proximate a free end of the tongue, wherein the tip portion is defined by a crease line extending across the tongue, the tip portion being folded about the crease line and adjacent the base portion and adjacent the coaster portion when the sleeve is in the in-use orientation.

7. The apparatus of claim 1, wherein the in-use orientation the sleeve includes a cavity defined by the body portion and the coaster and being configured to receive a cup therein, wherein the coaster defines a bottom of the cavity.

8. The apparatus of claim 1, wherein the blank is a unitary member.

9. An apparatus comprising:

a blank having:

a body portion; and a coaster portion extending therefrom;

the coaster portion being press fit against the body portion in an in-use orientation forming a generally multi-sided sleeve the coaster forming a bottom portion of the sleeve;

wherein the multi-sided sleeve includes at least six sides;

wherein the coaster portion includes five folding portions each defined by an inner arcuate crease line, wherein each inner arcuate crease line forms an arc that intersects with an outer periphery of the coaster portion.

10. The apparatus of claim 9, wherein each of the five folding portions include an outer arcuate portion that contacts a surface of a respective panel of the body portion, wherein the folding region of each of the five folding portions fold about the respective inner arcuate line in the in-use position.

11. The apparatus of claim 10, wherein each folding portion is press fit against a respective panel in the body portion such that the distance between a center point of the outer periphery of each free end of each folding portion to the upper arcuate edge is less than the distance between the inner arcuate line of each folding portion and the upper arcuate edge.

12. A method for forming a sleeve with a coaster, comprising:

providing a blank having:

a body portion; and a coaster portion extending therefrom;

press fitting the coaster portion against the body portion forming a generally six sided sleeve with the coaster forming a bottom portion of the sleeve:

wherein providing a blank includes forming a plurality of crease lines in the body portion defining seven panel sections; wherein press fitting the coaster portion against the body portion includes pressing an outer periphery of the coaster portion against five of the seven panel sections;

wherein the coaster includes at least five folding portions, each folding defined by an inner arcuate crease line, wherein each inner arcuate crease line forms an arc that intersects with an outer periphery of the coaster portion.

13. The method of claim 12, wherein providing a blank includes providing a tongue portion formed from the body portion and securing a tip portion of the tongue on the coaster.

14. The method of claim 13, further including inserting a conical cup within a cavity defined by the sleeve, wherein an upper arcuate edge of the body portion conforms to the shape of the conical cup and wherein a lower arcuate edge of the body portion has a six sided non-arcuate shape.

15. The method of claim 14, wherein the conical cup has a generally cylindrical shape with a base, wherein the coaster supports the base of the cup.

16. The method of claim 13, wherein press fitting the coaster against the body portion includes press fitting each folding portion against a respective panel in the body portion such that the distance between a center point of the outer periphery of each free end of each folding portion to an upper arcuate edge of the body portion is less than the distance between the inner arcuate line of each folding portion and the upper arcuate edge.

17. The method of claim 13 wherein the tongue includes a base portion extending a panel of the body portion and a tip portion proximate a free end of the tongue, wherein the tip portion is defined by a crease line extending across the tongue, the tip portion being folded about the crease line and adjacent the base portion and adjacent the coaster portion when the sleeve is in the in-use orientation.

* * * * *